US005263463A

United States Patent [19]

Perry

[11] Patent Number: 5,263,463

[45] Date of Patent: Nov. 23, 1993

[54] MOTORCYCLE COMPACT SUPERCHARGING APPARATUS

[76] Inventor: Leroy R. Perry, 1301 East Rubio St., Altadena, Calif. 91001

[21] Appl. No.: 885,635

[22] Filed: May 19, 1992

[51] Int. Cl.[5] ..... F02B 33/00

[52] U.S. Cl. ..... 123/559.1

[58] Field of Search ..... 123/559.1; 60/598, 605.1

[56] References Cited

U.S. PATENT DOCUMENTS

| | | | |
|---|---|---|---|
| 2,201,693 | 5/1940 | Heess et al. | 123/559.1 |
| 2,254,927 | 9/1941 | Archambeau | 123/559.1 |
| 2,681,646 | 6/1954 | Holpfer | 123/559.1 |
| 2,756,735 | 7/1956 | Oehrli | 123/559.1 |
| 2,839,038 | 6/1958 | Middlebrooks, Jr. | 123/559.1 |
| 2,844,133 | 7/1958 | Thompson | 123/559.1 |
| 4,417,559 | 11/1983 | Matsuda et al. | 123/559.1 |
| 4,444,013 | 4/1984 | Inoue et al. | 60/605 |
| 4,480,712 | 11/1984 | Inoue et al. | 123/559.1 |
| 4,482,024 | 11/1989 | Matsuda et al. | 123/559.1 |
| 4,495,773 | 1/1985 | Inoue et al. | 60/605.1 |
| 4,723,526 | 2/1988 | Horiuchi et al. | 123/559.1 |
| 4,844,044 | 7/1989 | McGovern | 123/559.1 |
| 4,907,552 | 3/1990 | Martin | 123/559.1 |
| 4,998,524 | 3/1991 | Black et al. | 123/559.1 |
| 5,085,199 | 2/1992 | Sado et al. | 123/559.1 |

FOREIGN PATENT DOCUMENTS

| | | | |
|---|---|---|---|
| 0196127 | 8/1990 | Japan | 123/559.1 |

*Primary Examiner*—Richard A. Bertsch
*Assistant Examiner*—Charles G. Freay
*Attorney, Agent, or Firm*—William W. Haefliger

[57] ABSTRACT

A motorcycle supercharger kit apparatus, the motorcycle having a forwardly extending frame, an engine carried by the frame, the engine having a power take-off shaft that extends sidewardly relative to the frame, the engine having an intake manifold above the level of the take-off shaft, comprising a blower including an elongated longitudinally extending housing, blower parts rotatable within the housing and blower input shaft structure operatively connected with the blower parts; a drive connected between the power take-off shaft and the blower input shaft structure; the blower housing having an air inlet, and a pressurized air outlet at one side of the housing; duct structure extending between the outlet and the engine intake manifold; plate structure at one end of the housing; and connector structure associated with the plate structure and drive to allow at least one of the following:

i) rotary power transmission axially from a belt-driven power rotor to the blower input shaft structure, ii) rotary power transmission through a fixed 90° angle from a belt-driven power rotor to the blower input shaft structure, iii) rotary power transmission through a selectable 90° angle from a belt-driven power rotor to the blower input shaft structure;

whereby the blower may have multiple possible operating positions relative to the engine and the power take-off shaft.

22 Claims, 29 Drawing Sheets 10
12
12a
12b
13
14
14
15
15a
18
19
20
21
21a
23
24
26
28
30
41
46
47
48
49
50
52
60
60a
60a
10b
11c
11d FIG. 25.
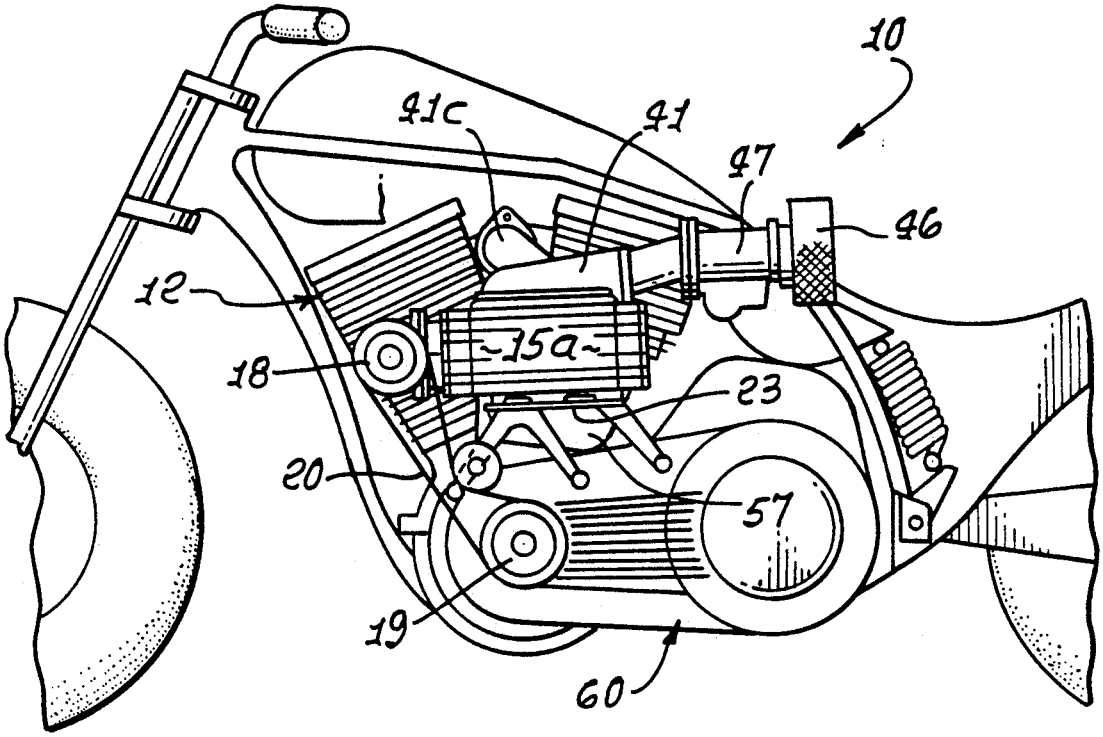
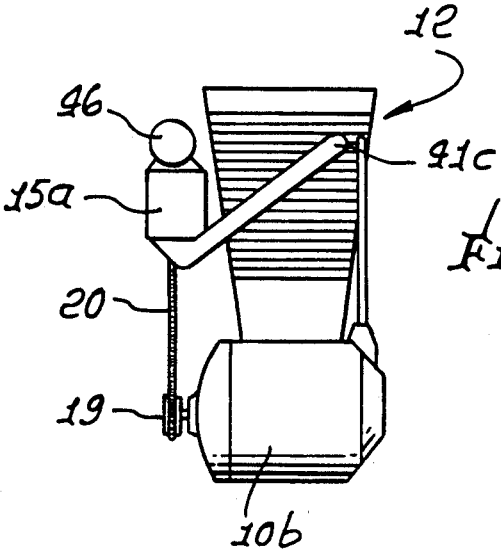
FIG. 25a.

FIG. 27.
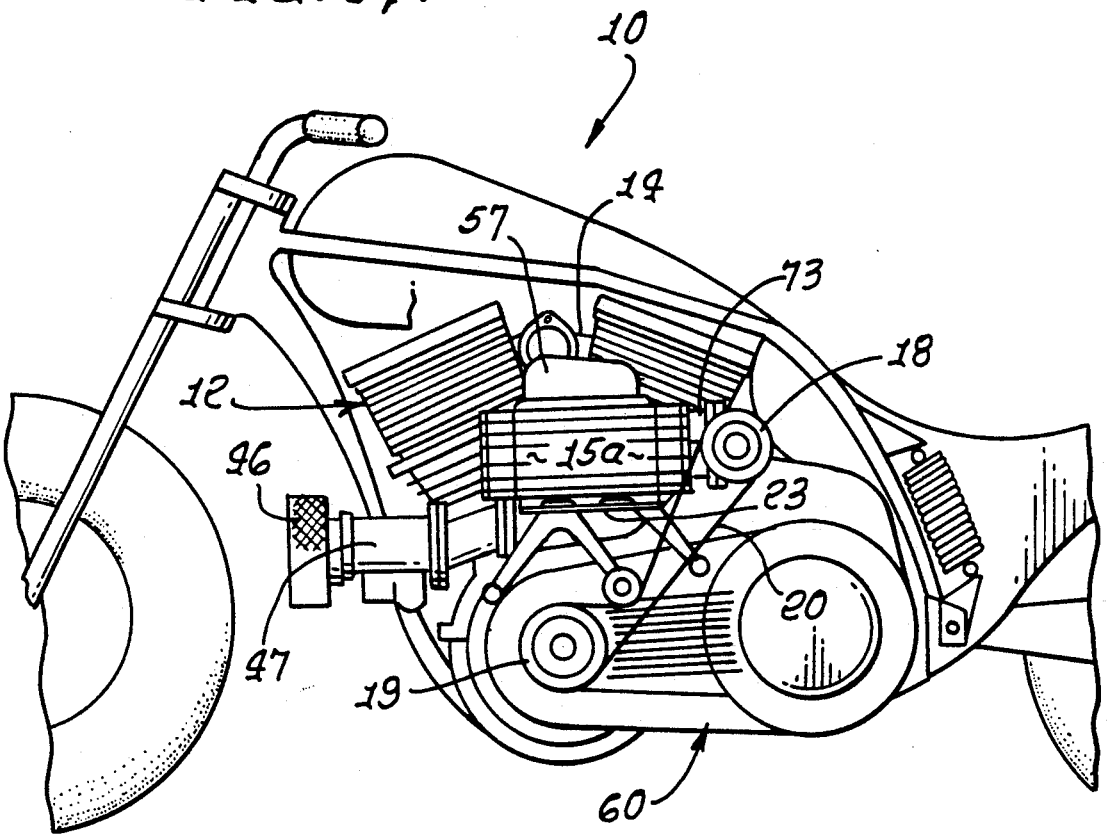
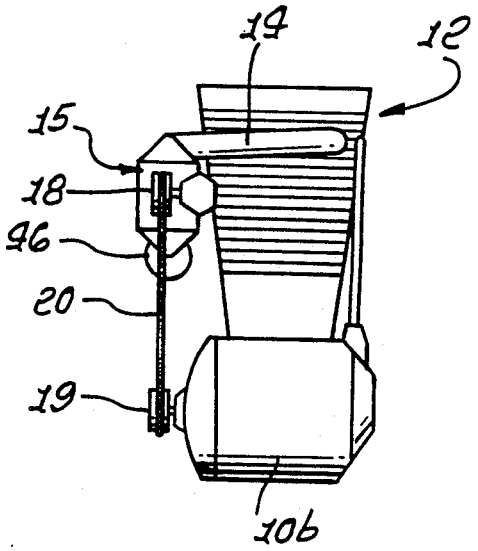
FIG. 27a.

FIG. 28.
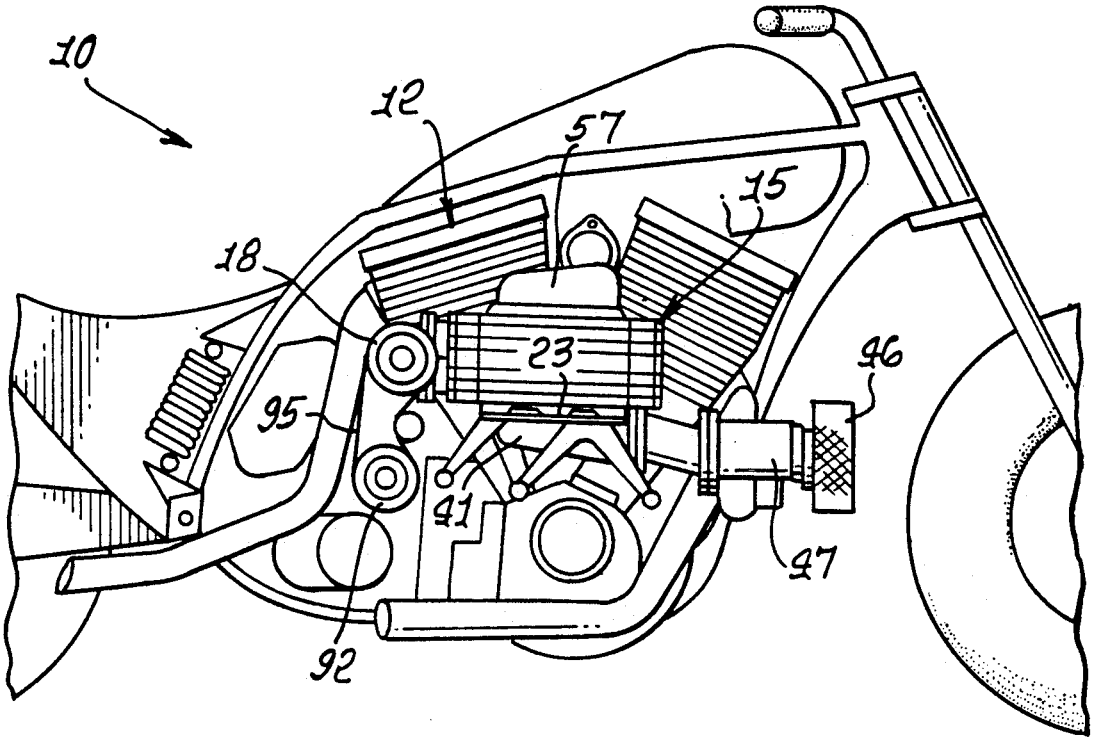
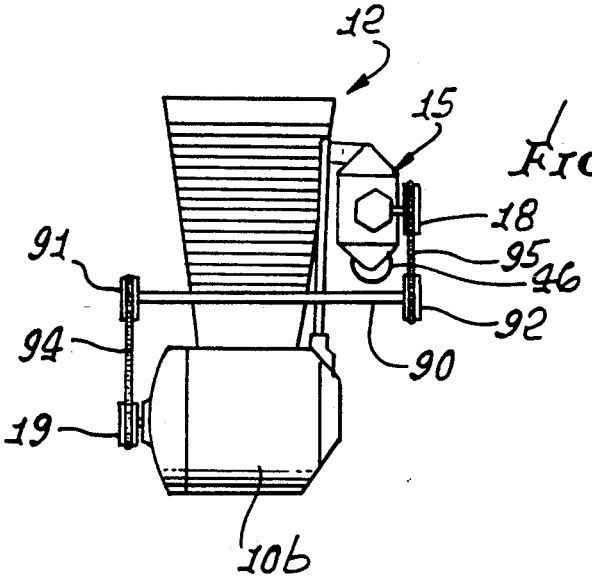
FIG. 28a.

FIG. 29.
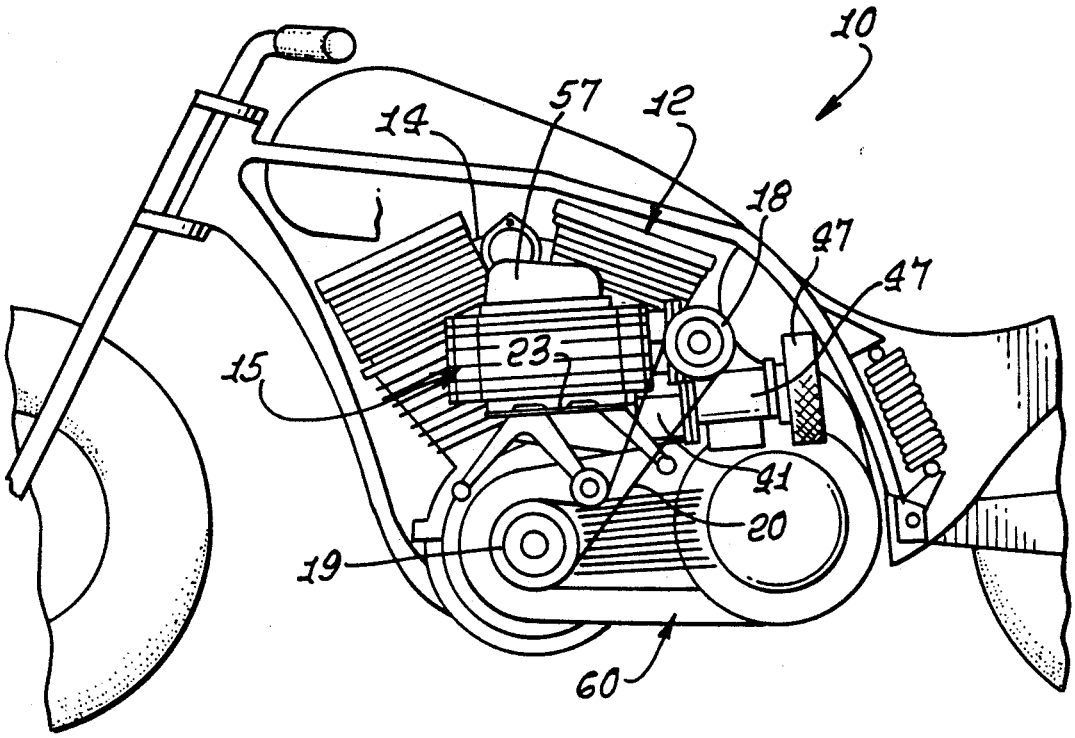
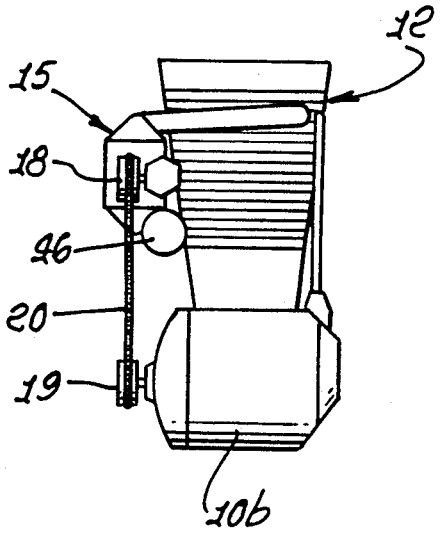
FIG. 29a.

FIG. 31.
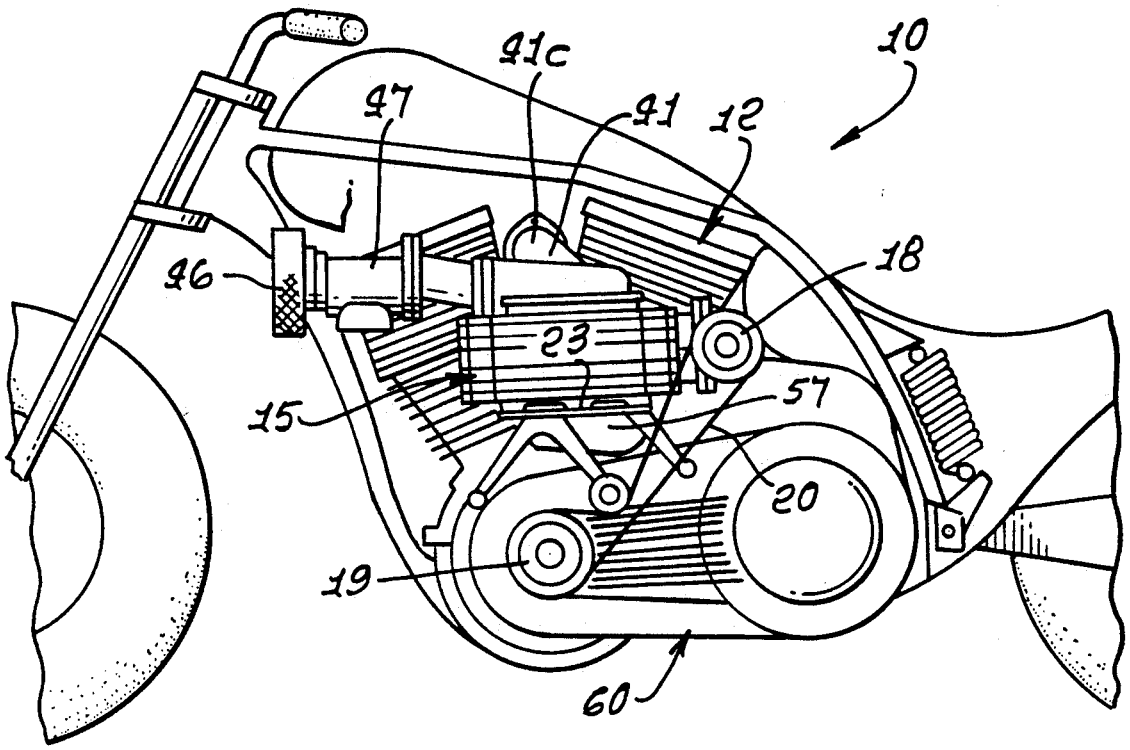
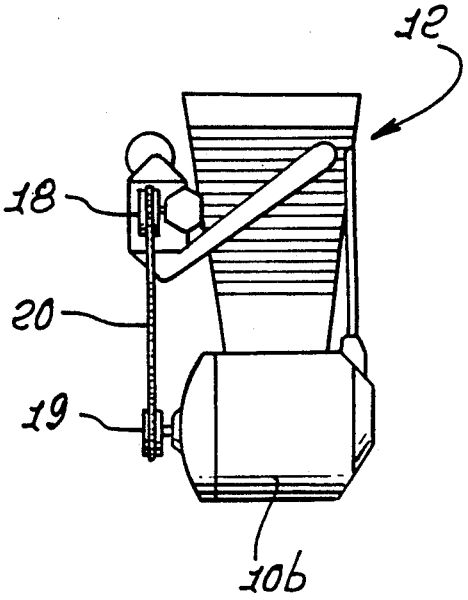
FIG. 31a.

FIG. 33.
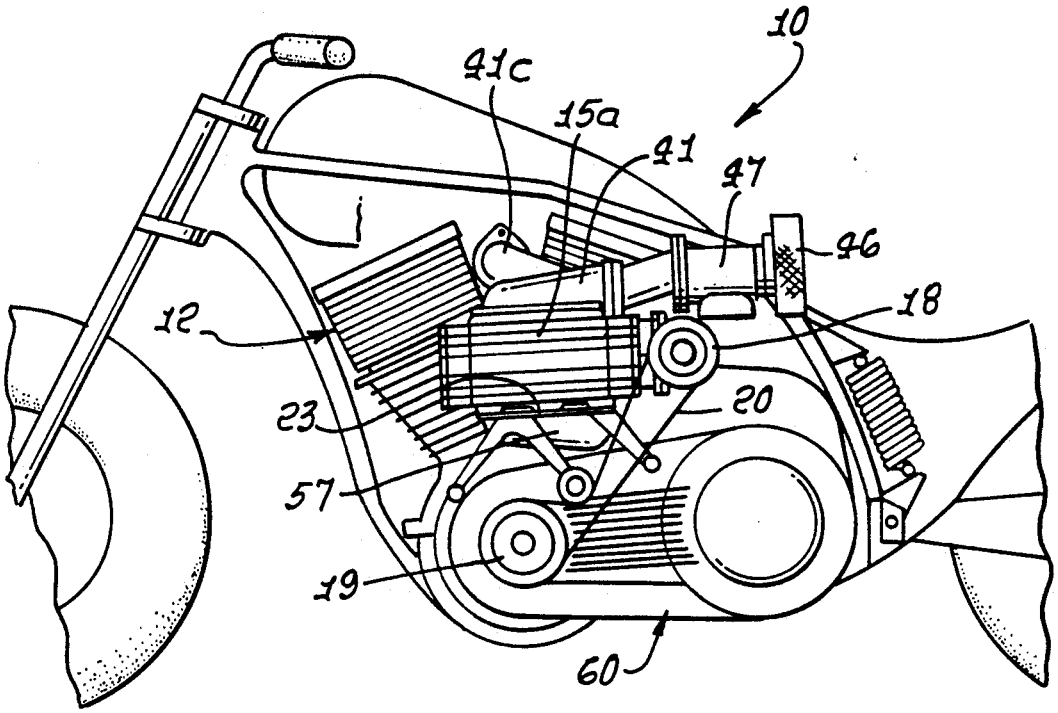
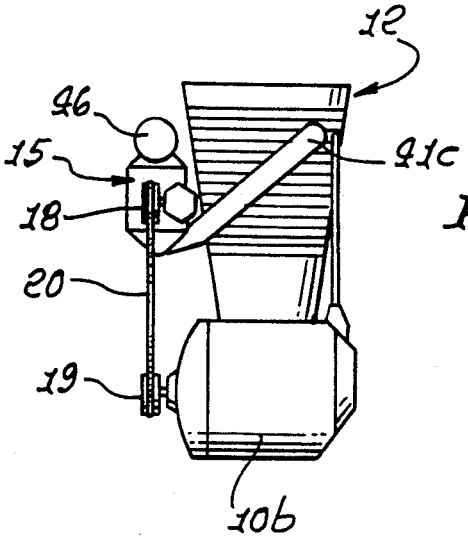
FIG. 33a.

MOTORCYCLE COMPACT SUPERCHARGING APPARATUS

BACKGROUND OF THE INVENTION

This invention relates generally to supercharging of motorcycle engines, and more particularly to compact, simple supercharge apparatus, as in kit form, readily attached to existing motorcycles.

There is need for simple, efficient supercharging means for motorcycle engines, non-interfering with the rider and the rider's legs. There is also need for supercharging apparatus readily attached to existing motorcycles, and further need for such apparatus in kit form, readily supplied to motorcycle owners, and attachable to the motorcycle at different positions thereon.

SUMMARY OF THE INVENTION

It is a major object to provide improved supercharging apparatus for motorcycles meeting the above needs. Basically, the apparatus is attachable to a motorcycle having a forwardly extending frame, an engine carried by the frame, the engine having a power take-off shaft that extends sidewardly relative to the frame, the engine having an intake manifold above the level of the take-off shaft. The apparatus comprises:

a) a blower including an elongated longitudinally extending housing, blower parts rotatable within the housing and blower input shaft means operatively connected with the blower parts, b) a drive connected between the power take-off shaft and the blower input shaft means, c) the blower housing having an air inlet, and a pressurized air outlet at one side of the housing, d) duct means extending between the outlet and the engine intake manifold, e) plate means at one end of the housing, f) and connector means associated with the plate means and drive to allow at least one of the following:

i) rotary power transmission axially from a belt-driven power rotor to the blower input shaft means, ii) rotary power transmission through a fixed 90° angle from a belt-driven power rotor to the blower input shaft means, iii) rotary power transmission through a selectable 90° angle from a belt-driven power rotor to the blower input shaft means g) whereby the blower may have multiple possible operating positions relative to the engine and the power take-off shaft.

It is a further object to provide such apparatus wherein the support includes a platform which extends lengthwise of the blower housing, the arm means including arms which are spaced lengthwise of the platform and project at the side of the platform opposite the blower housing, for bolt connection to the motorcycle frame, engine, or combination thereof.

It is another object to provide such apparatus wherein the arm means includes at least three or more longitudinally spaced arms which project downwardly below the level of the platform and below the blower housing.

It is yet another object to provide such apparatus wherein the drive includes a first rotor connected to the power take-off shaft, a second rotor at the level of the blower housing and operatively connected to the blower input shaft means, and an endless, flexible element entrained on the first and second rotors to transmit rotary drive therebetween.

As will be seen, the rotors may comprise pulleys and the endless element may comprise a belt, and an idler pulley is typically carried by the platform and sidewardly engaging the belt to tension same. In one advantageous form of the invention, the first rotor is generally below the blower housing and the second rotor is generally forwardly of the blower housing, the drive including a connection between the second rotor and the blower input shaft means.

Yet another object is to provide such apparatus wherein the connection between the second rotor and the blower input shaft means comprises a 90° sub-drive, the blower input shaft means defining a longitudinally forwardly extending axis, and the first and second rotors defining laterally extending axes. Typically, the blower housing air inlet is then located at the underside of the blower housing, there being an air/fuel inlet manifold extending from the blower housing air inlet forwardly beneath the level of the second rotor, and operatively connected to means supplying fuel to the manifold. Also, a protective cover plate is typically located to extend in a generally vertical plane to cover the first and second rotors and the endless element, the plate being carried by the motorcycle engine or frame, and generally sidewardly close to the engine cylinders, whereby the rider's leg is protected from the supercharger and its drive.

An additional object is to provide such apparatus wherein the duct means, as referred to, is attached to the upper side of the blower housing and extends laterally toward the engine intake manifold located between forward and rearward engine cylinders, the blower housing also located in closely laterally spaced relation to the forward and rearward cylinders.

The invention also contemplates locating the blower housing forwardly of the engine, and the blower input shaft means then extending generally laterally, relative to the engine. To this end, the kit of the invention allows positioning of the blower housing in a number of positions relative to the engine, as will be seen.

Finally, the apparatus may include a second blower housing, blower parts rotatable within the housing and blower input shaft means operatively connected with the blower parts, the second support carrying the second housing sidewardly of the engine, the support having arm means bolt-connected to the motorcycle engine or frame, whereby the housing is elongated lengthwise of the engine or frame, the drive also connected with the second blower input shaft means, the second blower housing having an air inlet, and a pressurized air outlet at the upper side of the housing, and second duct means extending between the second housing air outlet and the engine intake manifold. In this regard, the blower housing may be located at opposite sides of, and close to, the engine cylinders, as will be seen.

According, a very compact, simple, efficient supercharging means for a motorcycle is provided.

These and other objects and advantages of the invention, as well as the details of an illustrative embodiment, will be more fully understood from the following specification and drawings, in which:

DRAWING DESCRIPTION

FIG. 1 is a perspective view of a motorcycle equipped with the supercharger kit, as referred to;

FIG. 1*a* is a right angle drive associated with the supercharger;

FIG. 1*b* is a schematic front view of the FIG. 1 supercharger drive;

Figure 13:
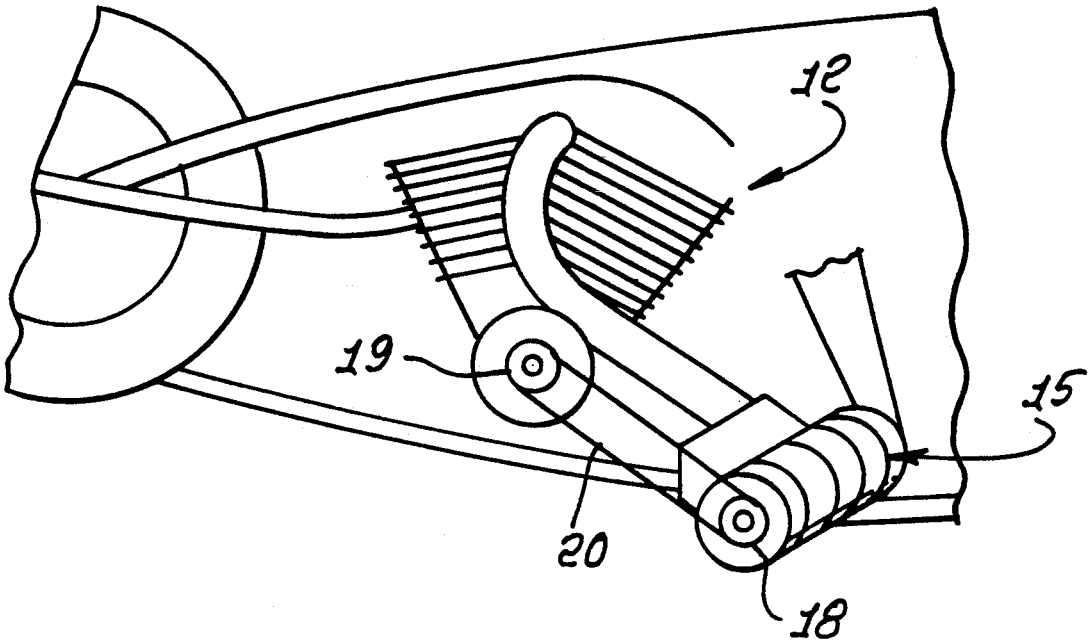
FIG. 13 is a partial view of a motorcycle with the supercharged housing mounted below and forwardly of the engine, to extend laterally relative to the motorcycle.
Figure 13A:
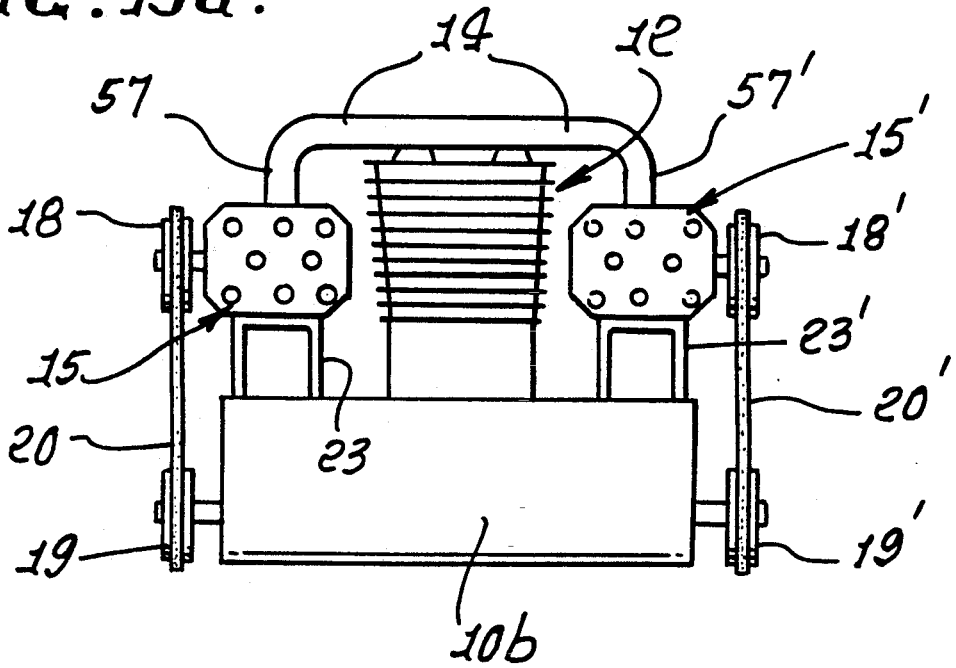
Figure 14:
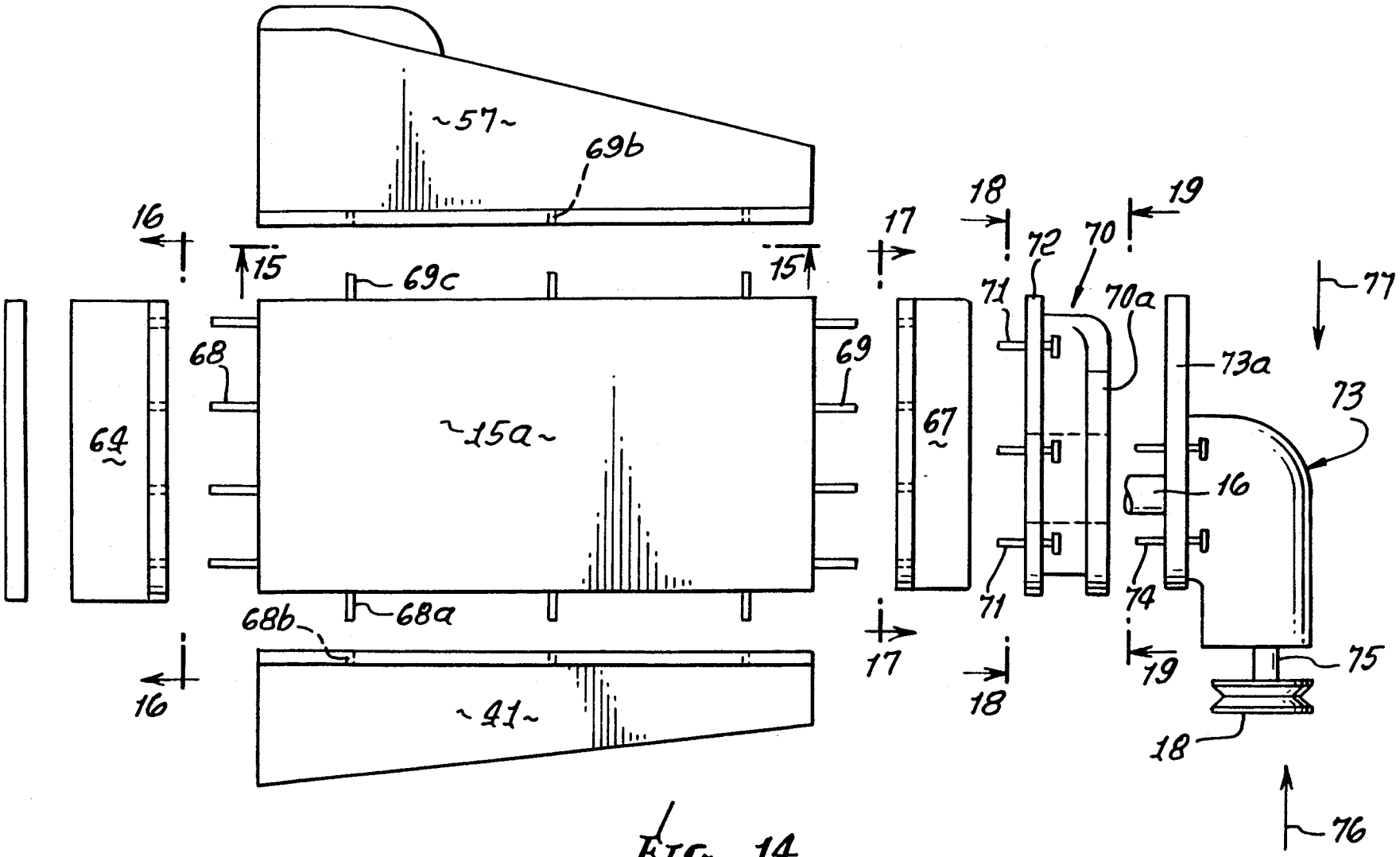
Figure 15:
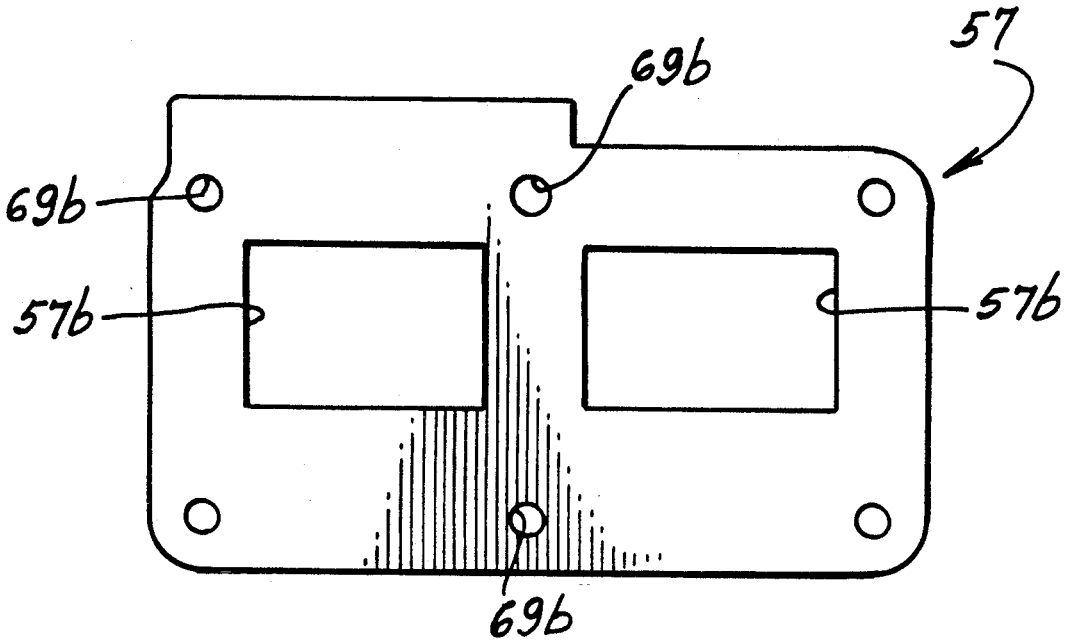
Figure 16:
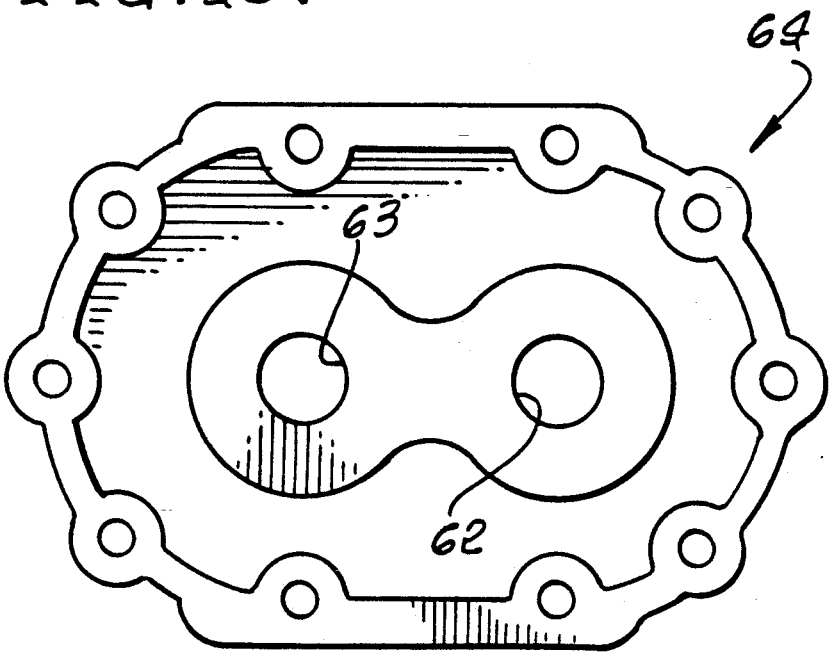
Figure 17:
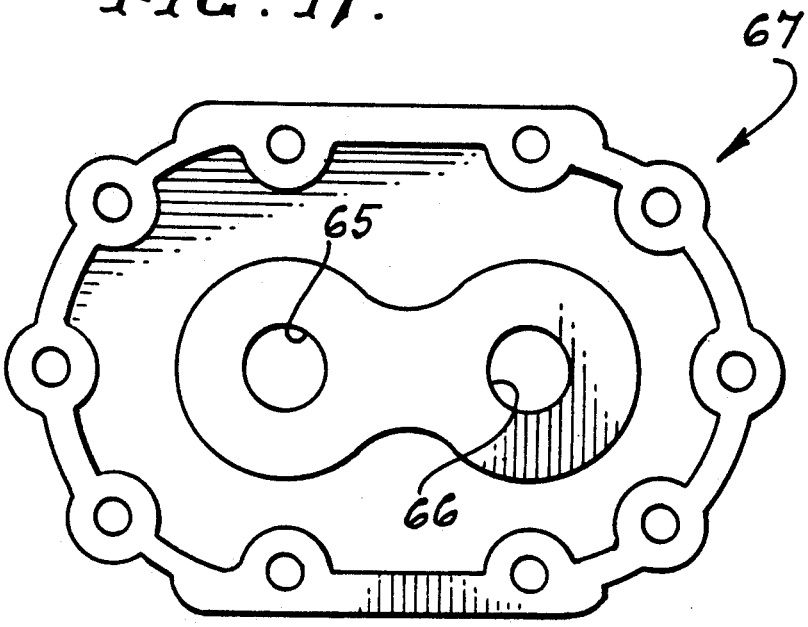
Figure 18:
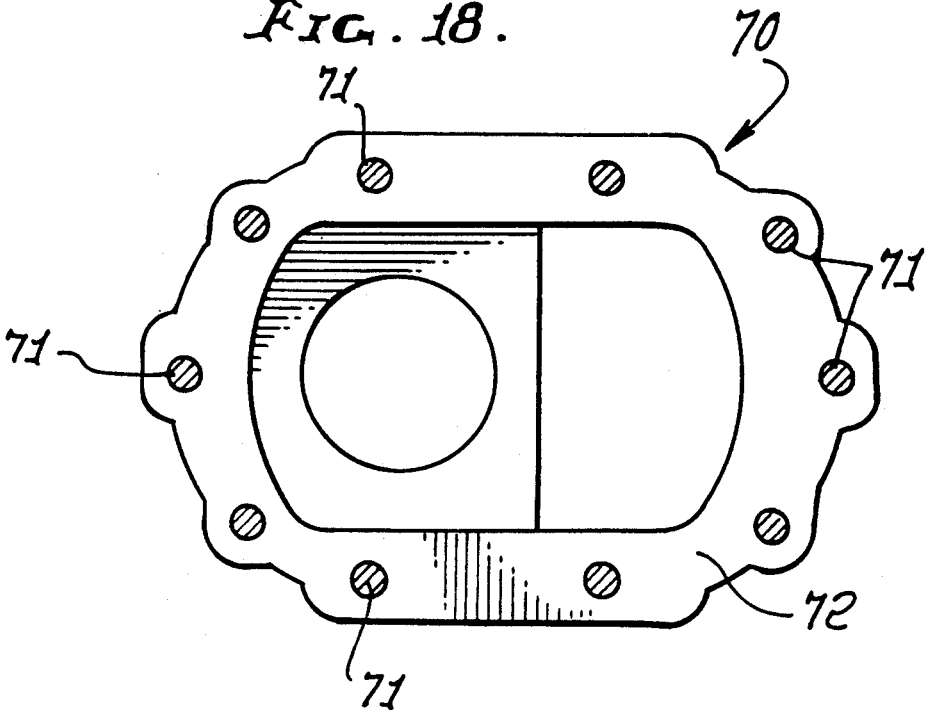
Figure 19:
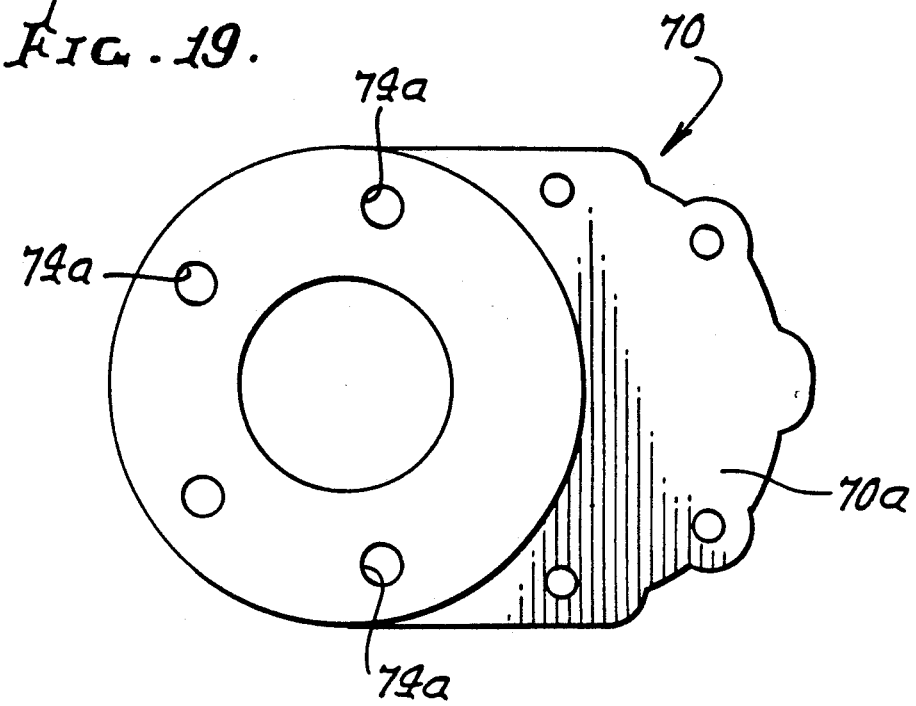
Figure 19A:
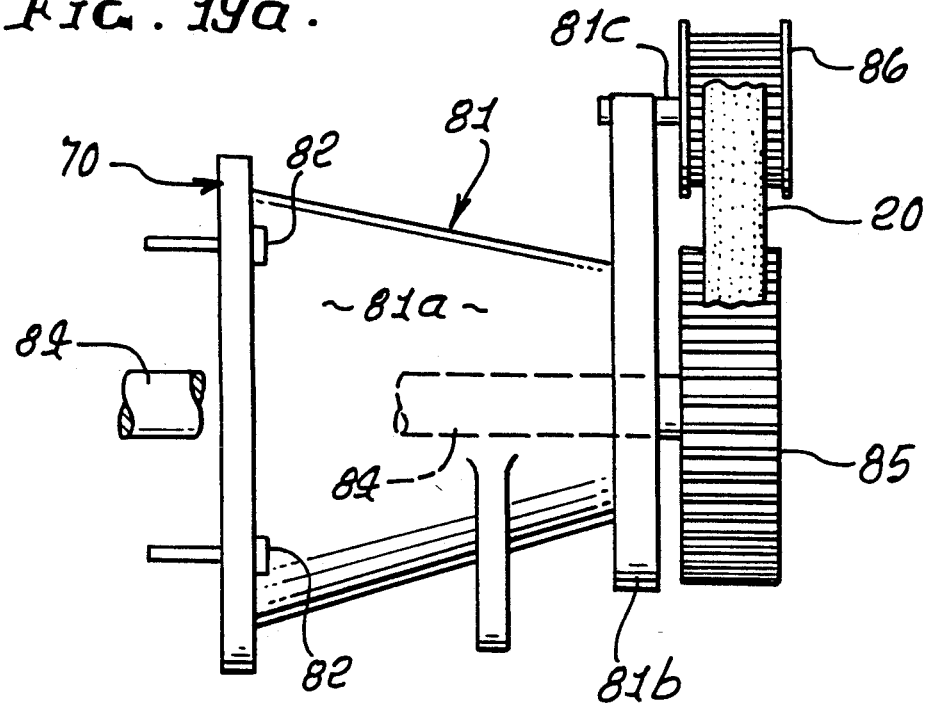
Figure 20:
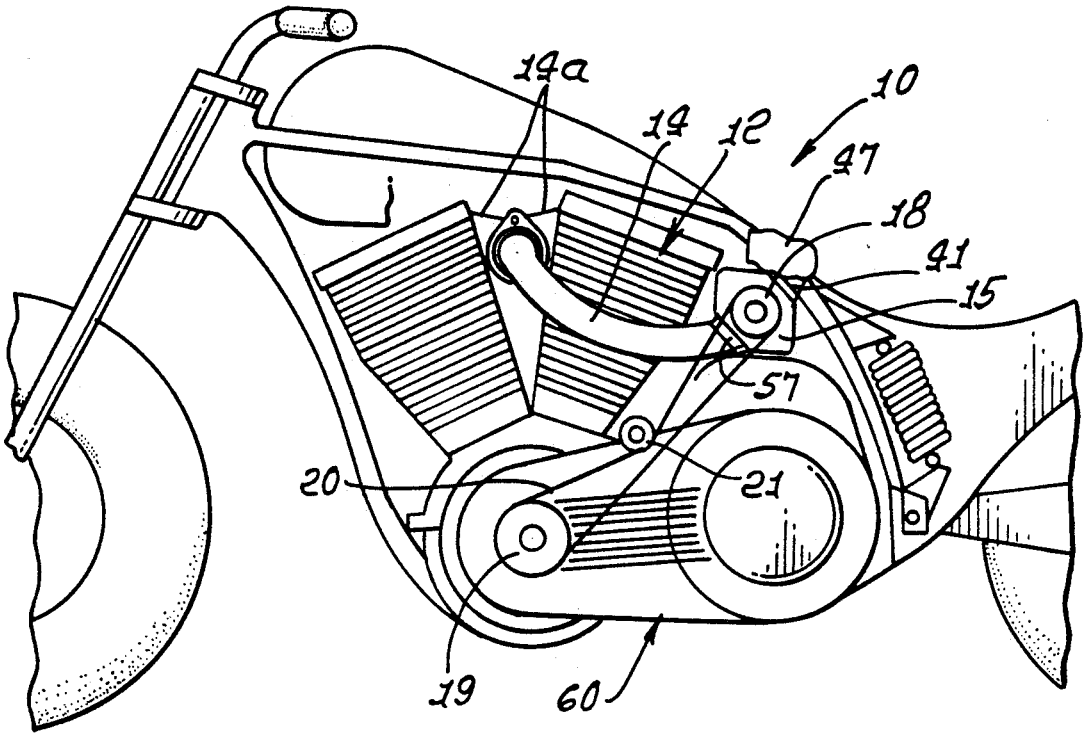
Figure 21:
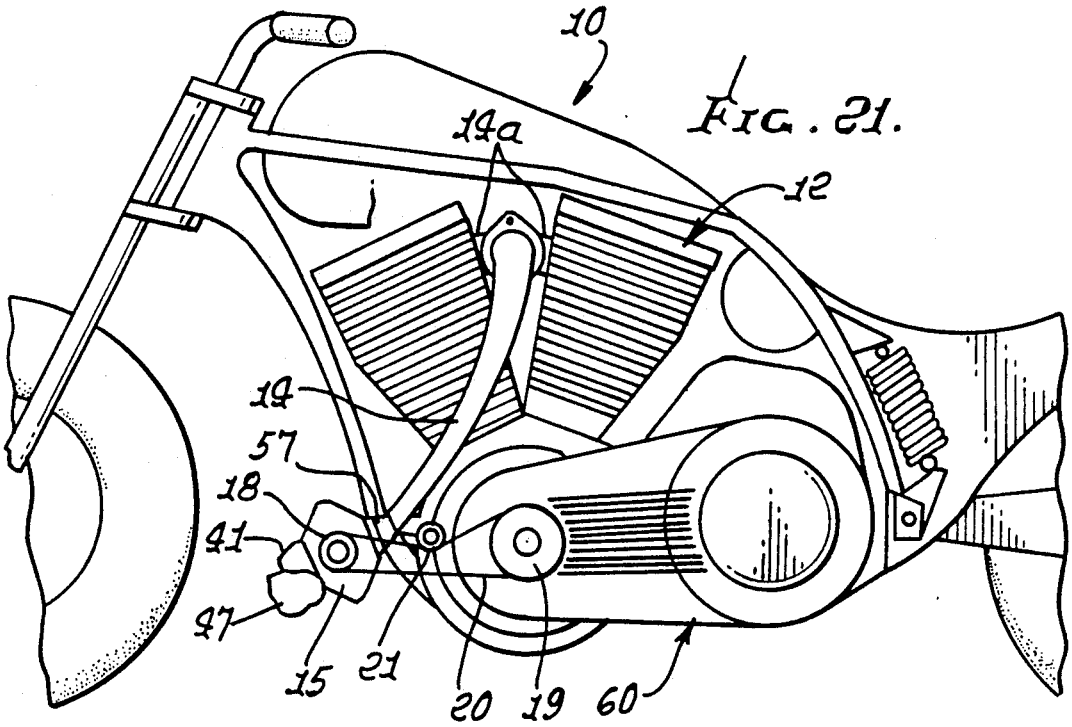
Figure 22:
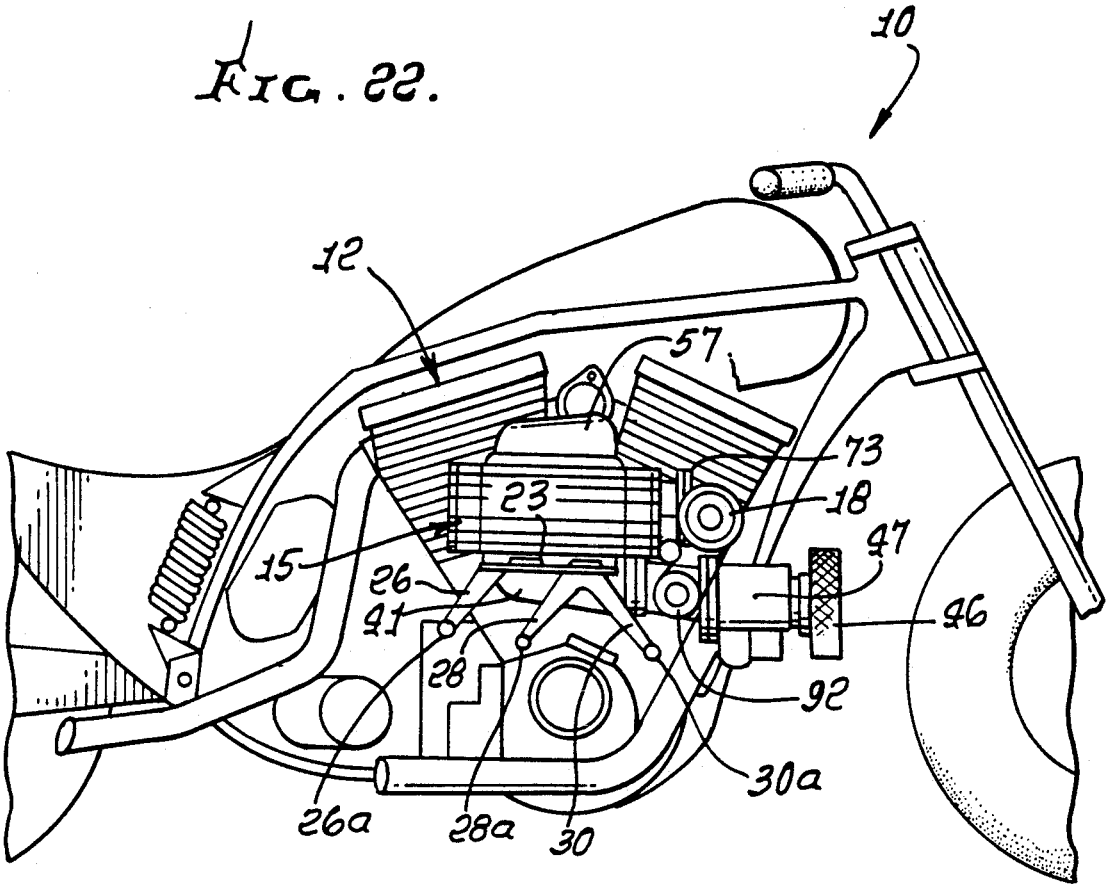
Figure 22A:
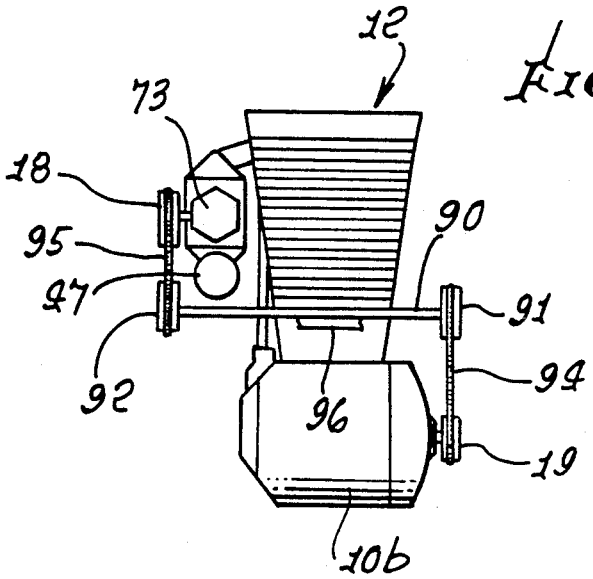
Figure 23:
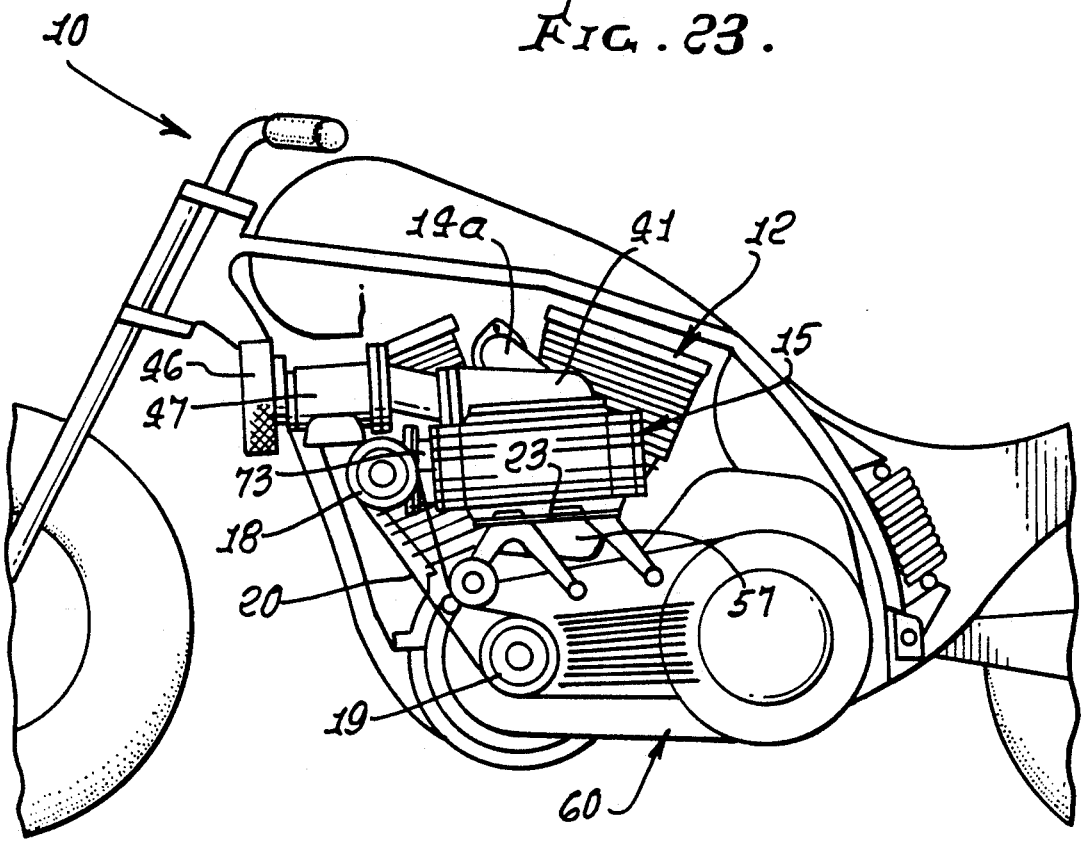
Figure 23A:
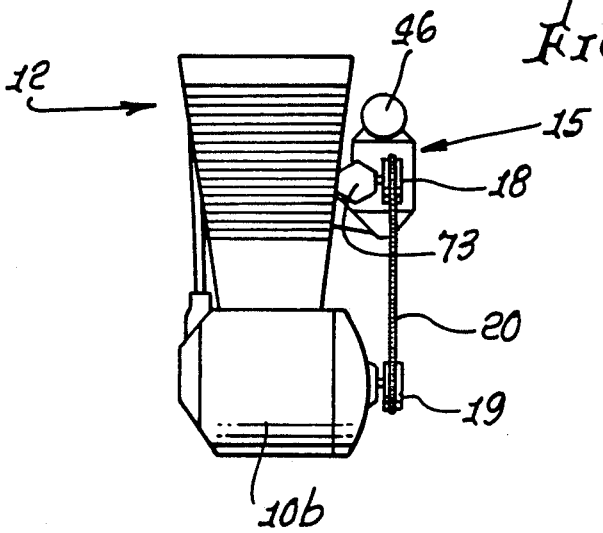
Figure 24:
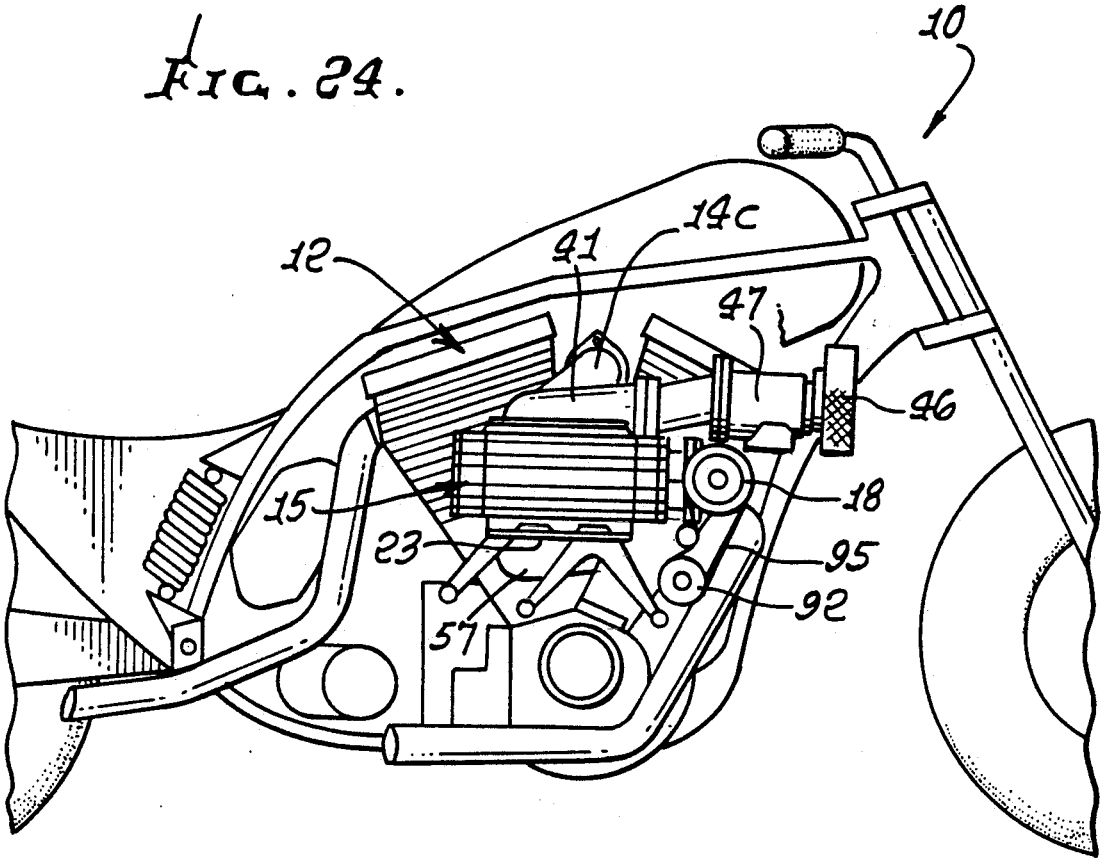
Figure 24A:
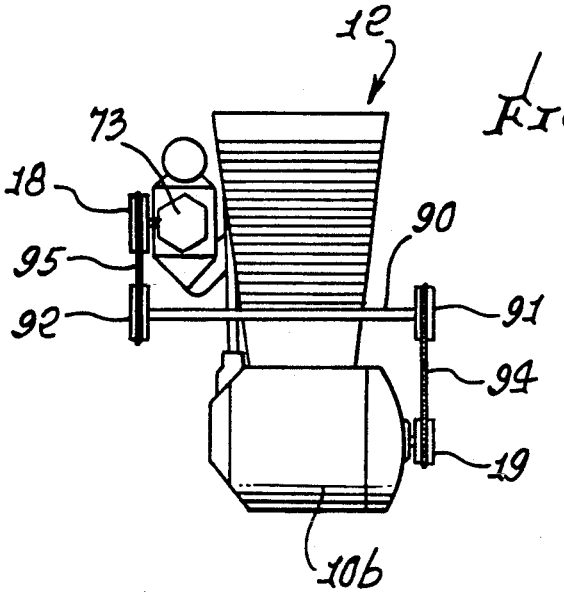
Figure 26:
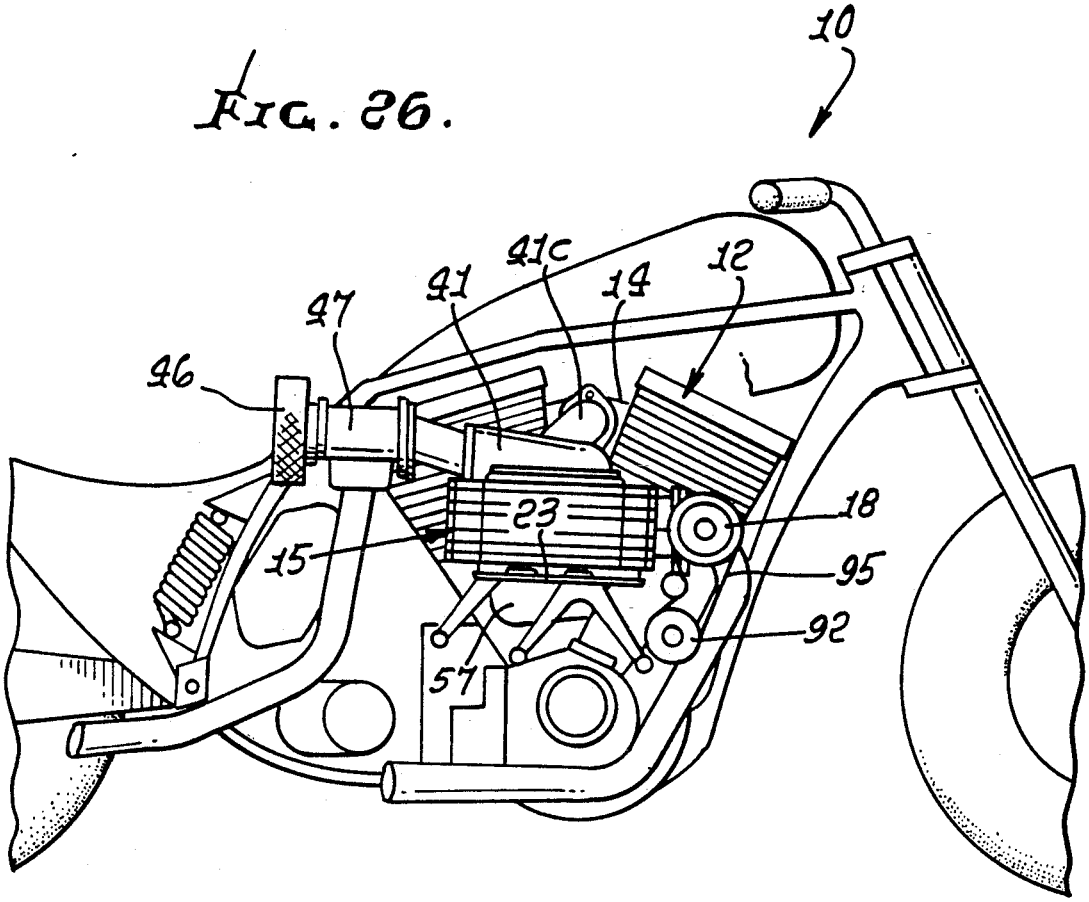
Figure 26A:
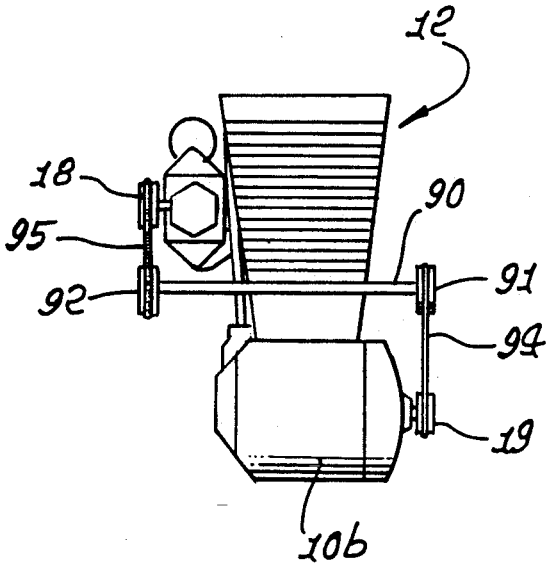
Figure 30:
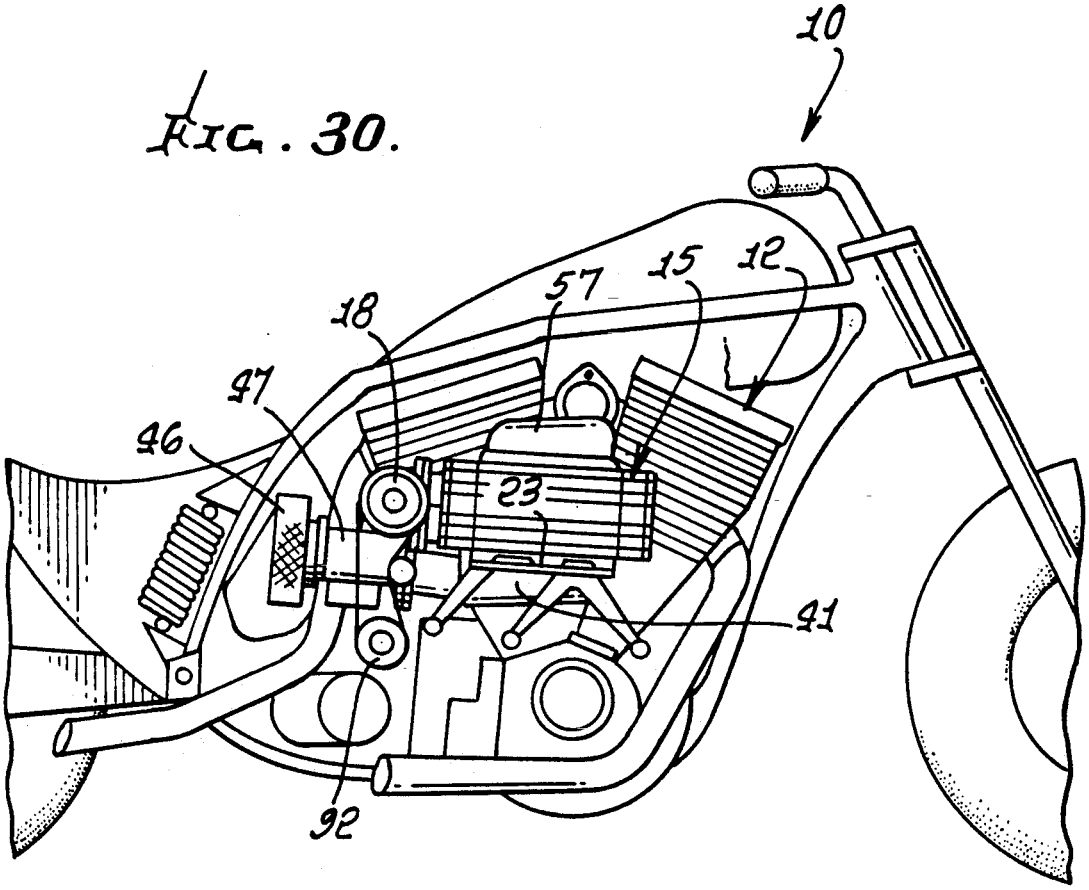
Figure 30A:
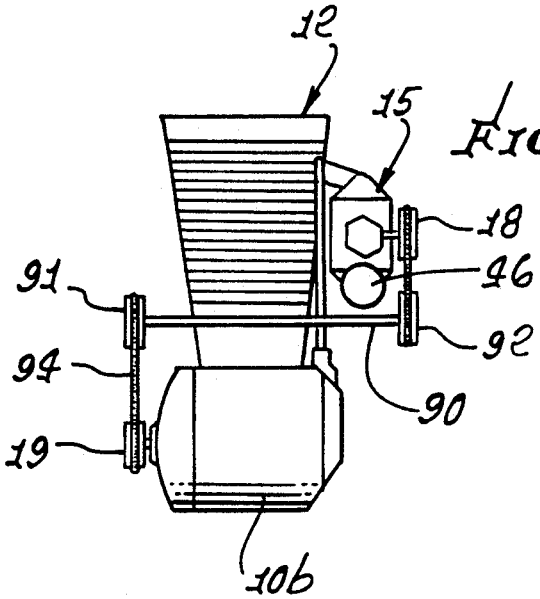
Figure 32:
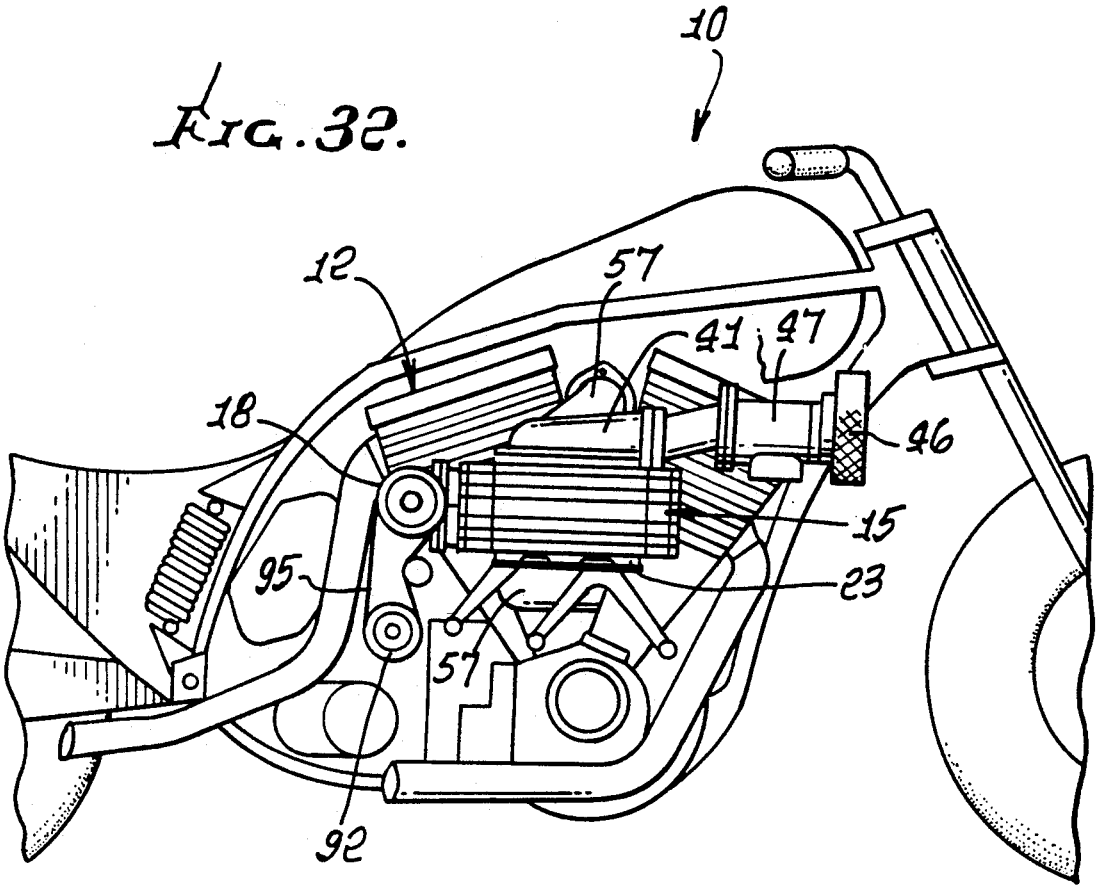
Figure 32A:
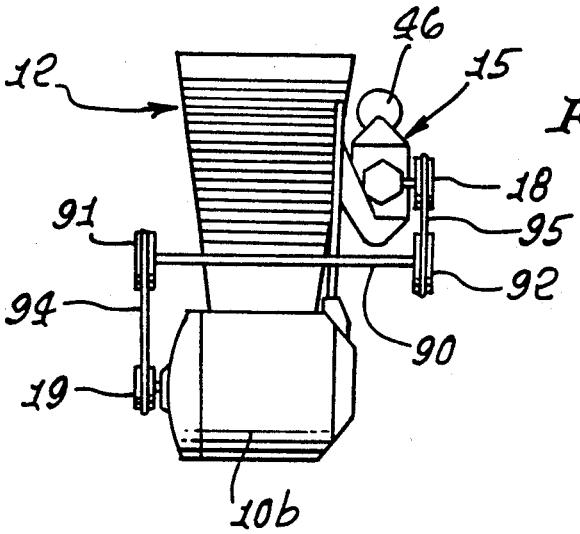
Figure 34:
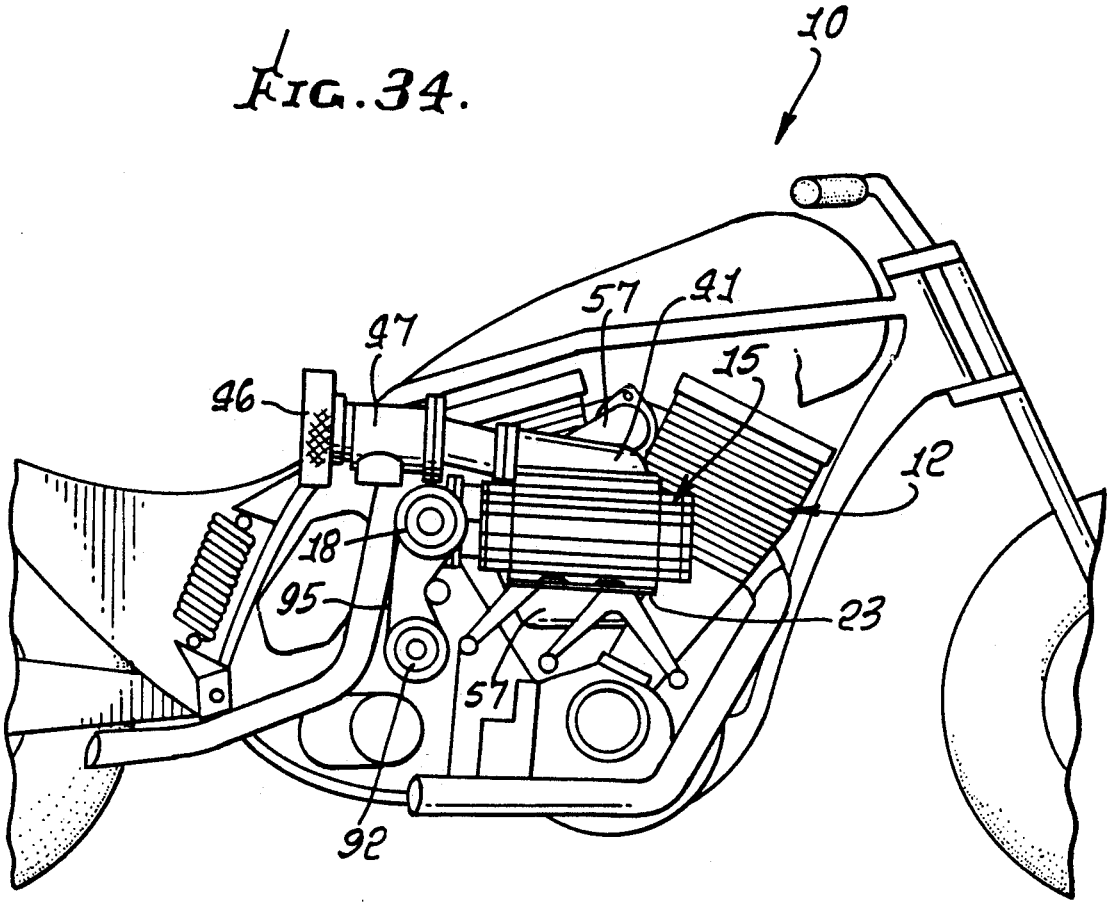
Figure 34A:
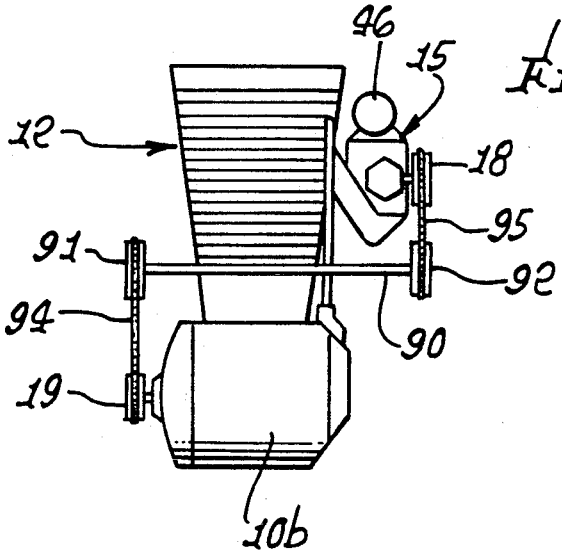
Figure 35:
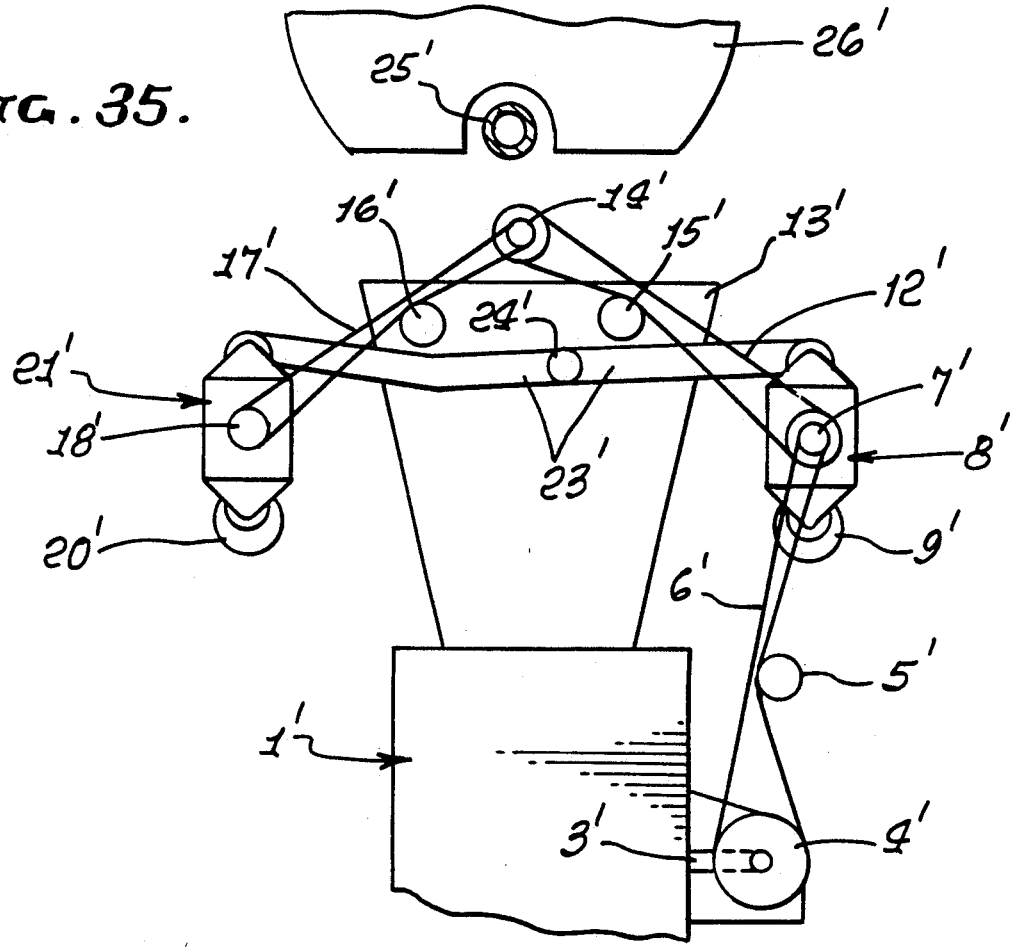
Figure 36:
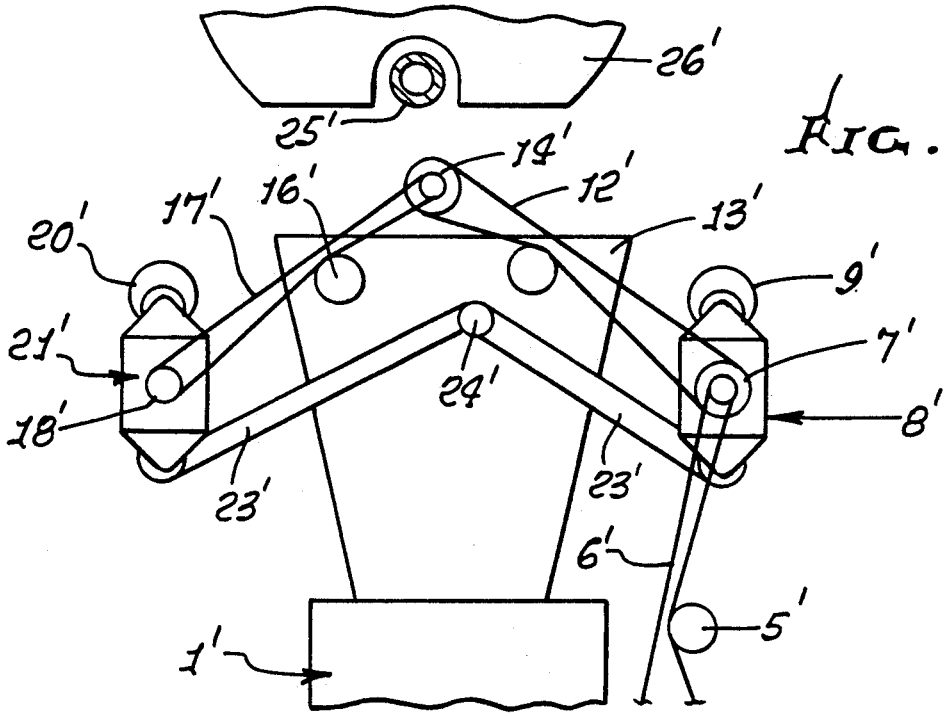
Figure 37:
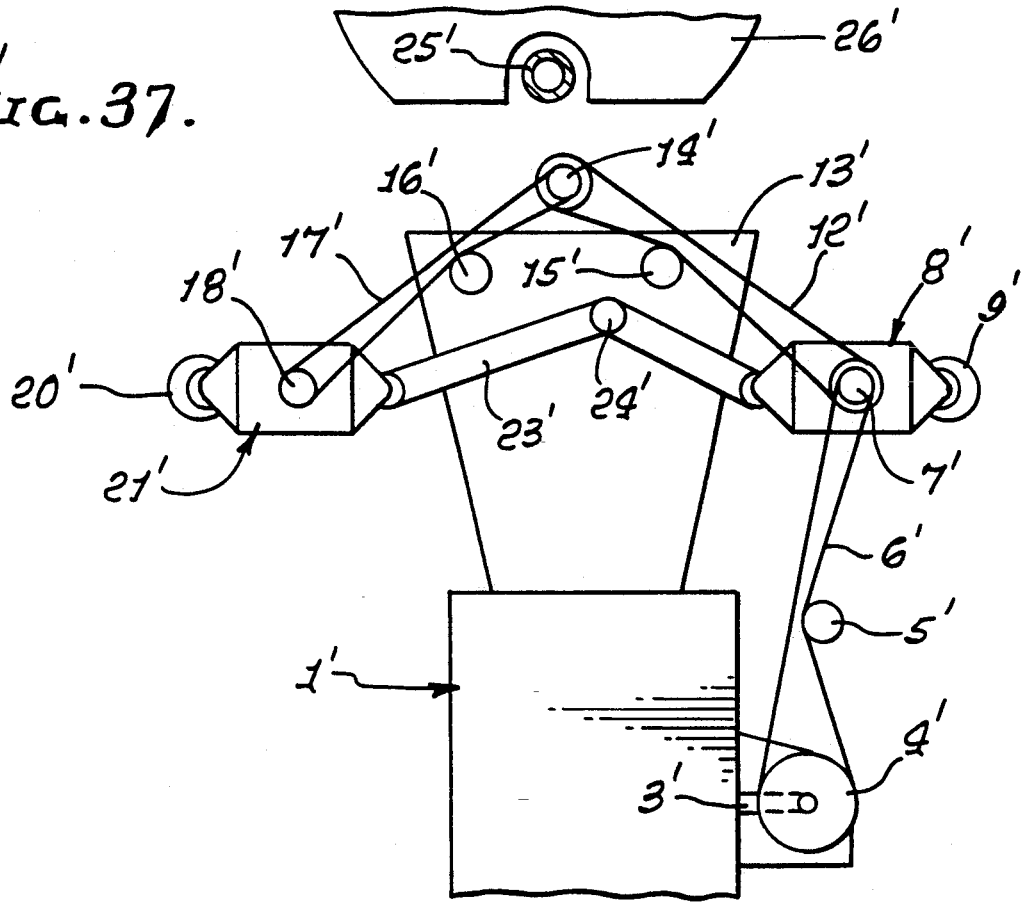
Figure 38:
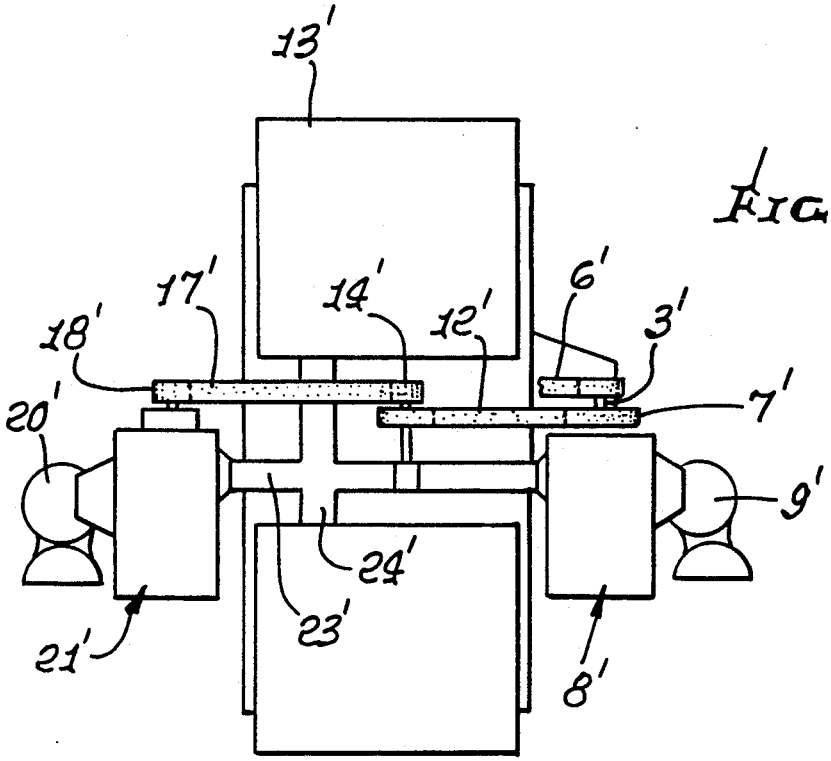
Figure 39:
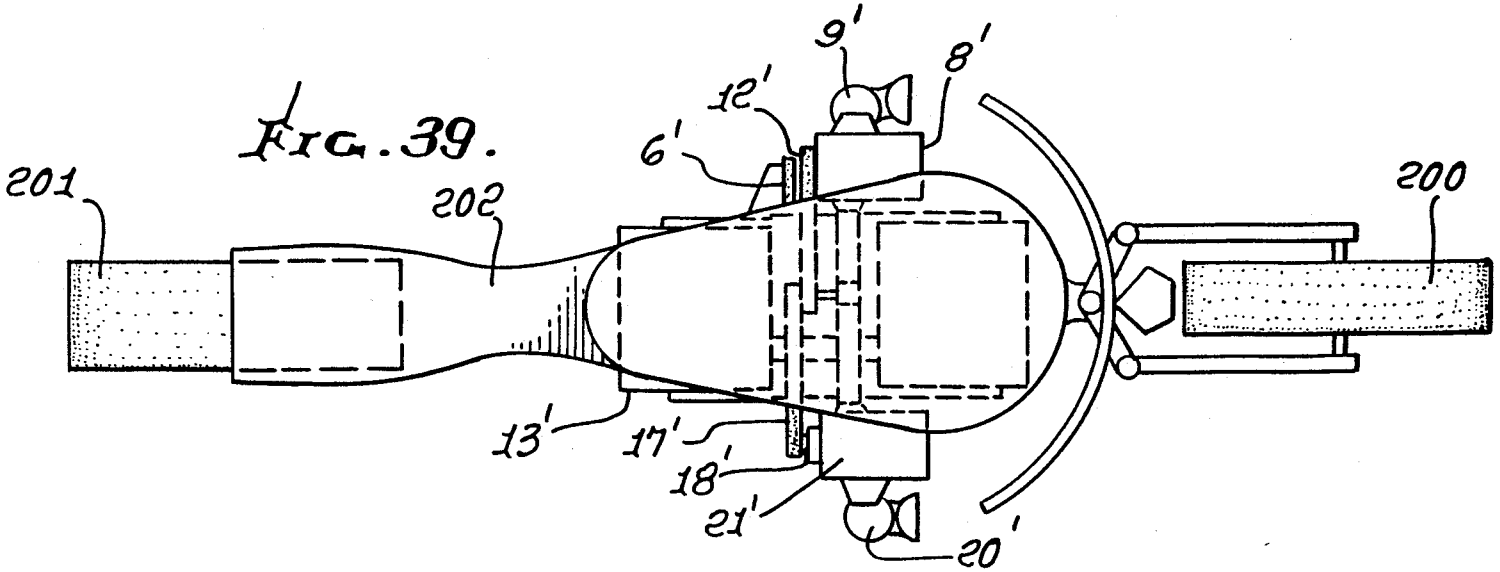
Figure 40:
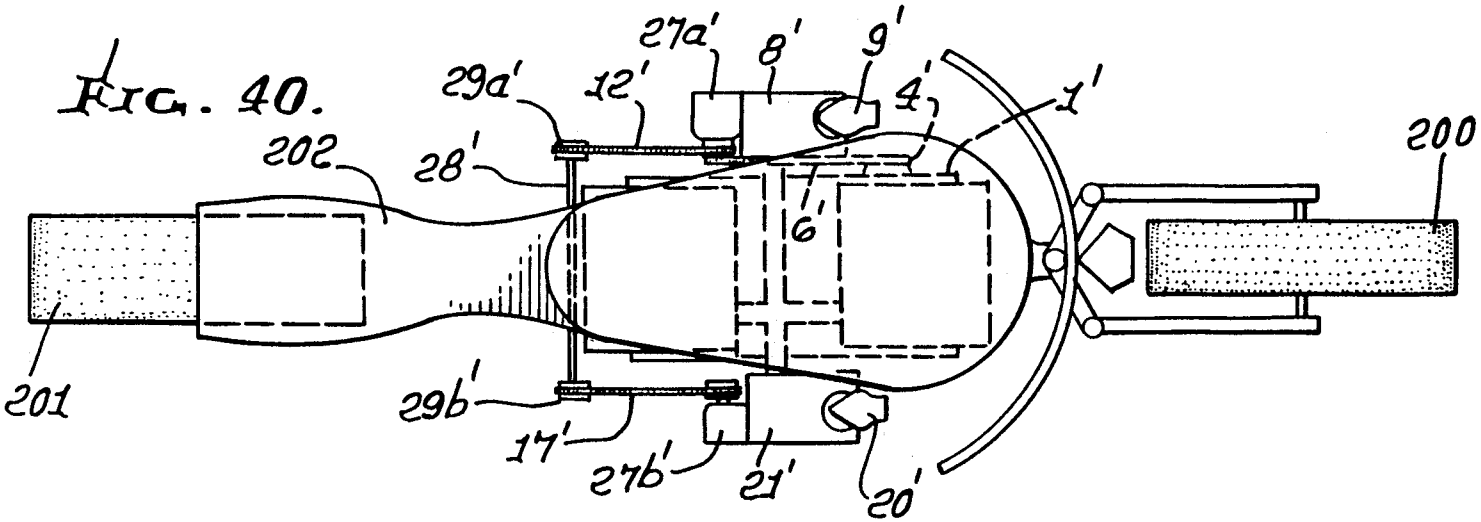
Figure 41:
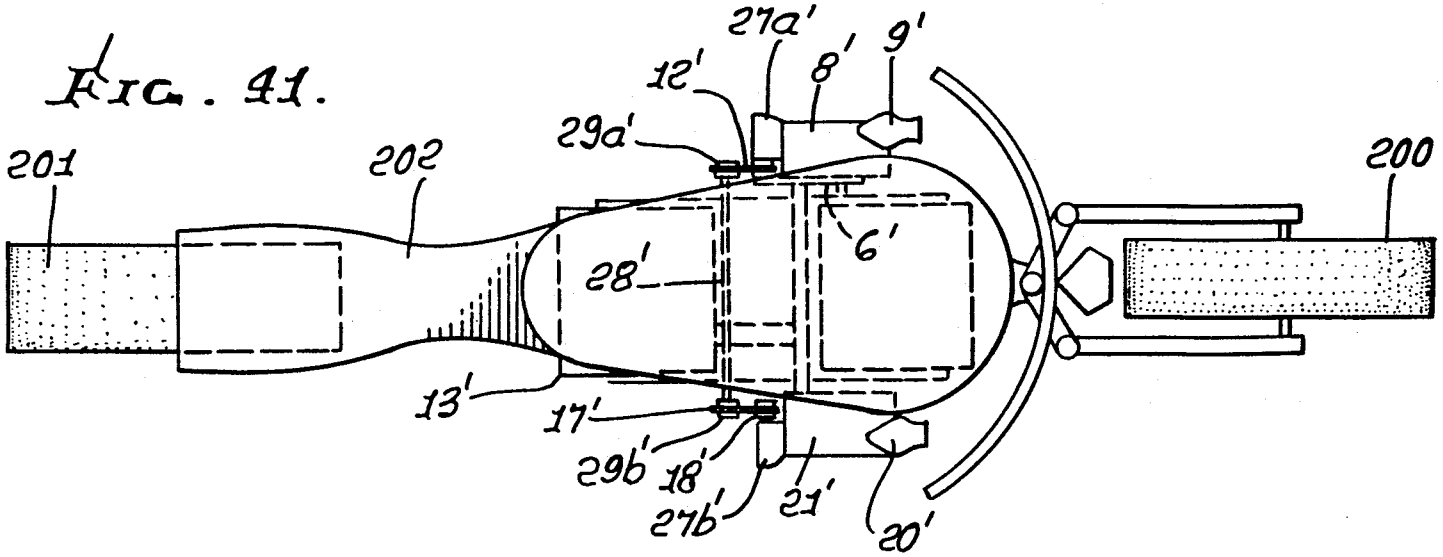

FIG. 13*a* is a schematic view of a dual supercharger arrangement;

FIG. 14 is an exploded view of the blower kit;

FIG. 15 is a plan view on lines 15—15 of FIG. 14;

FIG. 16 is an end view taken on lines 16—16 of FIG. 14;

FIG. 17 is an end view taken on lines 17—17 of FIG. 14;

FIG. 18 is an end view taken on lines 18—18 of FIG. 14;

FIG. 19 is an end view on lines 19—19 of FIG. 14;

FIG. 19*a* is an exploded view of a 180° drive for the supercharger;

FIG. 20 is a schematic side view showing the kit supercharger mounted at the top rear of the engine;

FIG. 21 is a schematic side view showing the kit supercharger mounted at the lower front of the engine;

FIG. 22 is a schematic side view showing the kit supercharger mounted at the right side of the motorcycle engine; and FIG. 22*a* is a schematic front view of the FIG. 22 supercharger drive;

FIG. 23 is a schematic side view of the kit, with the supercharger at the left side of the engine, and manifold flowing the fuel air mixture downwardly through the supercharger;

FIG. 23*a* is a front schematic view of the FIG. 23 drive;

FIGS. 24 and 24*a* are like FIGS. 23 and 23*a* but with the supercharger mounted at the right side of the engine;

FIG. 25 is like FIG. 23 but with the carburetor located rearwardly of the blower housing; and FIG. 25*a* is a rear schematic view of the supercharger drive;

FIG. 26 is like FIG. 25 but with the blower housing mounted at the right side of the engine; and FIG. 26*a* is a frontal schematic view of the FIG. 26 blower drive;

FIG. 27 is a view like FIG. 2 but showing the carburetor projecting forwardly below the blower housing;

FIG. 27*a* is an end view of the FIG. 27 engine and blower drive;

FIG. 28 is like FIG. 27 but showing the blower mounted at the right side of the engine;

FIG. 28*a* is an end view of the FIG. 28 engine and blower drive;

FIG. 29 is like FIG. 27 but showing the carburetor projecting rearwardly; and FIG. 29*a* is a schematic rear view of the blower drive;

FIG. 30 is a view like FIG. 29 but with the blower mounted at the engine right side; and FIG. 30*a* is a schematic rear view of the blower drive;

FIG. 31 is a view like FIG. 27 but with the carburetor projecting forwardly above blower level;

FIG. 31*a* is an end view of the FIG. 31 engine blower drive;

FIG. 32 is like FIG. 28 but showing the blower mounted at the engine right side; and FIG. 32*a* is a schematic rear view of the blower drive;

FIG. 33 is like FIG. 32 but with the carburetor projecting rearwardly above blower level; and FIG. 33*a* is a schematic rear view of the FIG. 32 blower drive;

FIG. 34 is a view like FIG. 32 but showing the carburetor projecting rearwardly; and FIG. 34*a* is a schematic rear view of the FIG. 34 blower drive;

FIG. 35 is a schematic top plan view of a motorcycle with dual, vertically oriented supercharger carburetors mounted below;

FIG. 36 is like FIG. 35 but with carburetor mounted on top;

FIG. 37 is like FIG. 35 but with superchargers oriented horizontally laterally;

FIG. 38 is a schematic plan view of a motorcycle with dual superchargers and carburetor mounted laterally;

FIG. 39 is a schematic plan view of a motorcycle with dual superchargers, 180° drives;

FIG. 40 is like FIG. 39 but with 90° drives to the two superchargers, between the V-cylinders; and FIG. 41 is like FIG. 39 but with carburetors projecting rearwardly, and supercharger drives in front of the front cylinder.

Figure 42:
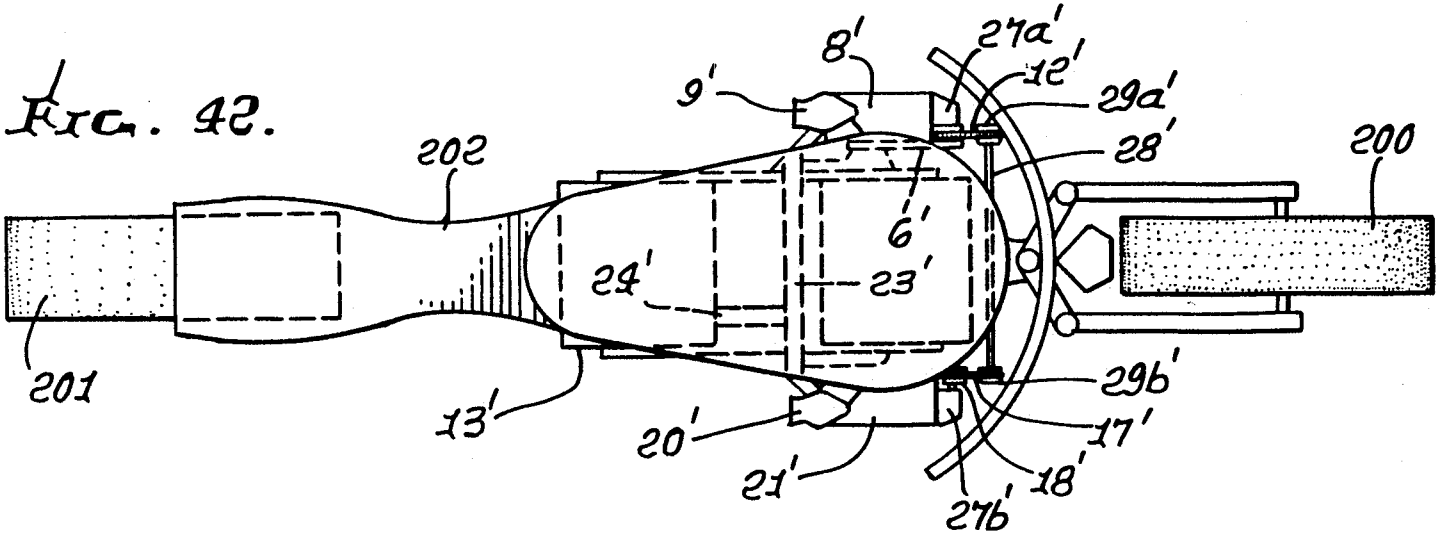

FIG. 42 is like FIG. 39 but with the transverse power shaft 28' forward of the front engine cylinder.

DETAILED DESCRIPTION

Figure 1B:
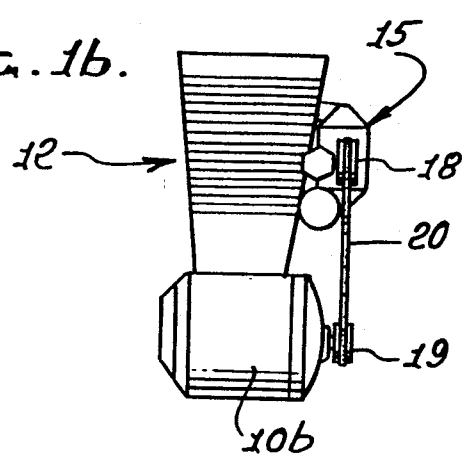
Figure 1A:
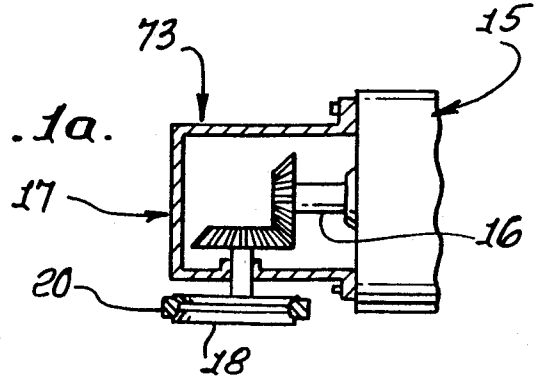
Figure 1:
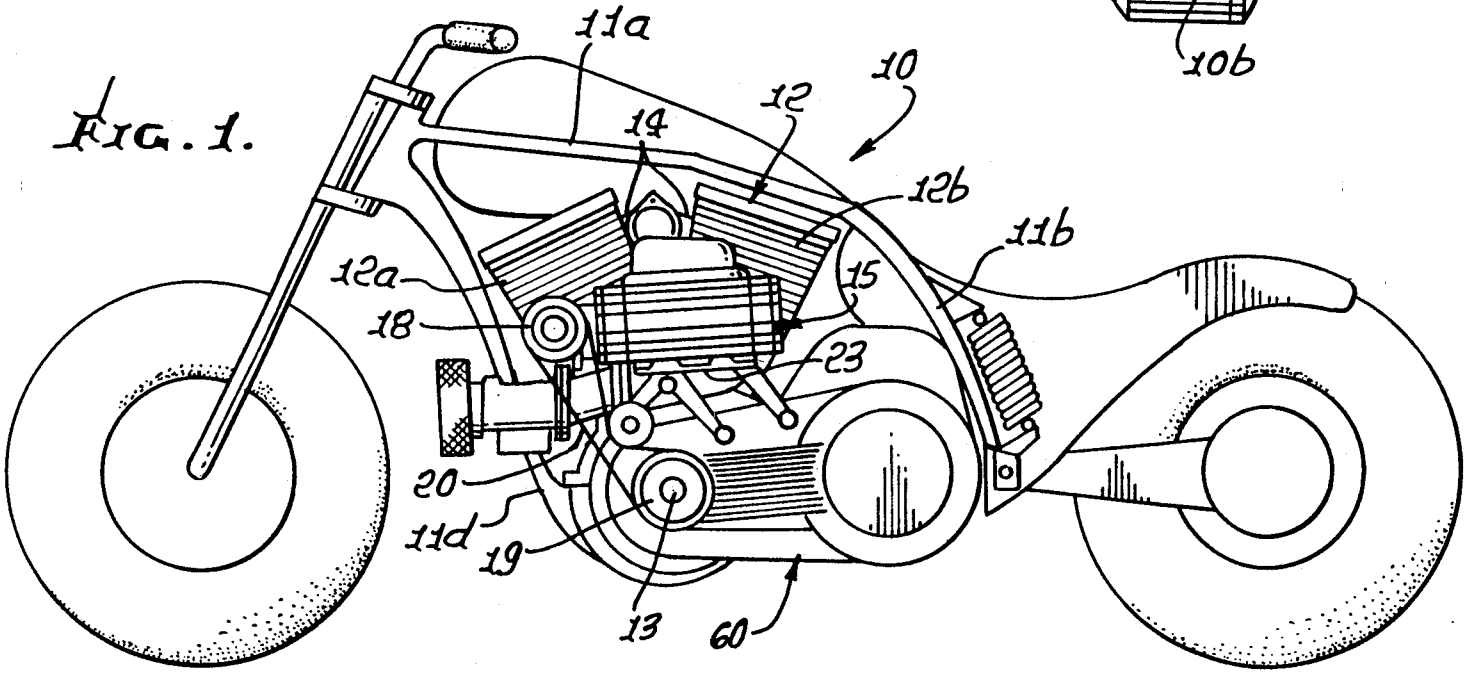
Figure 2:
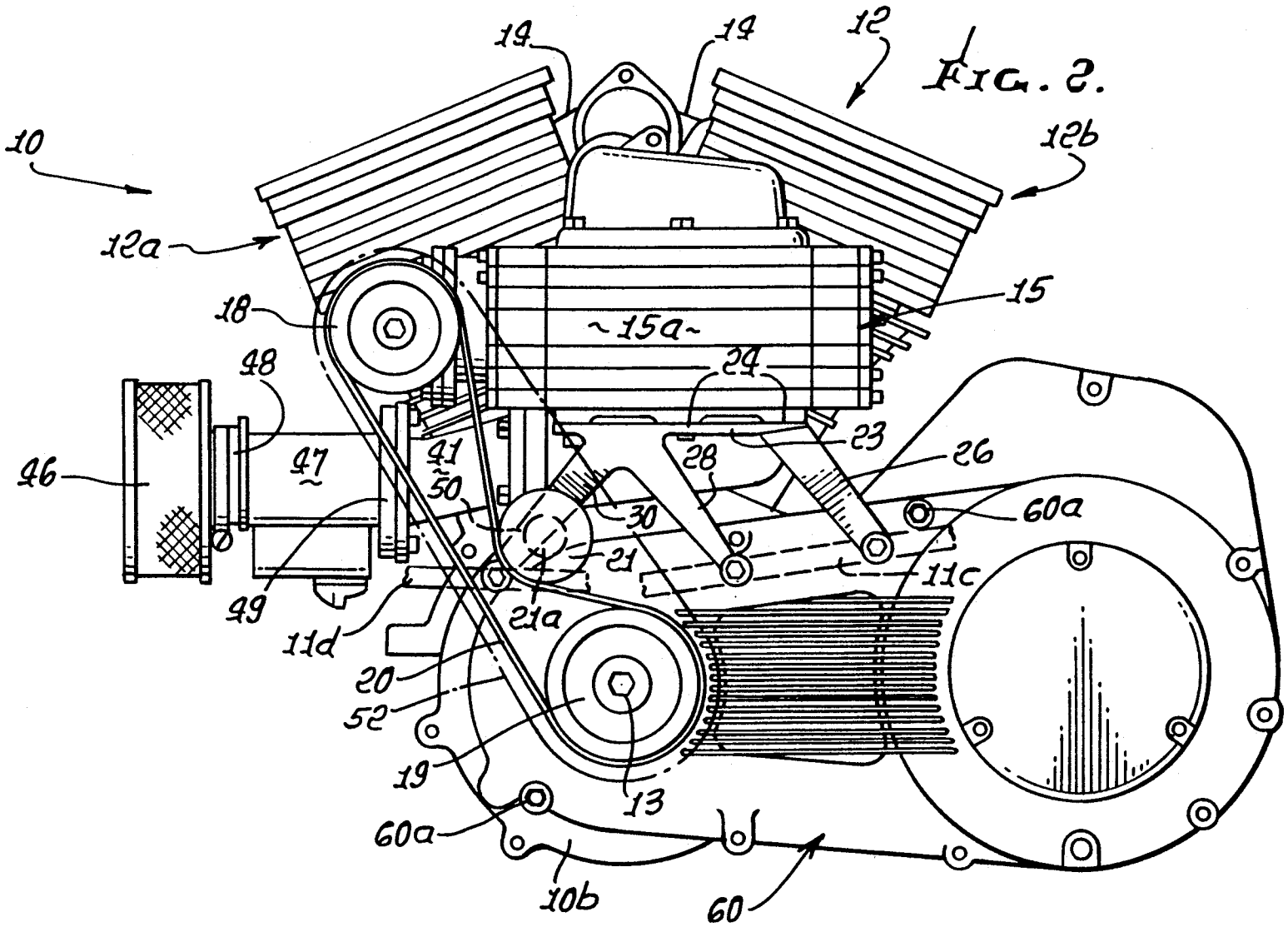
FIG. 2 is an enlarged side elevation showing the supercharger and its kit elements mounted to the motorcycle.
Figure 3:
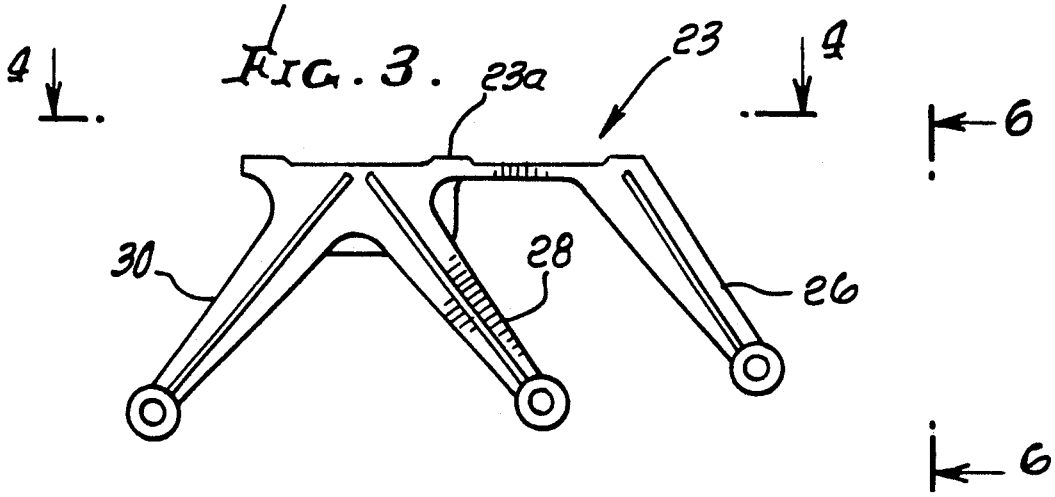
FIG. 3 is a side view of a supercharger housing platform.

In FIGS. 1, 1*a* and 2, the motorcycle 10 has a forwardly extending frame, with frame elements 11*a*—11*d*, as shown, there being other frame elements not shown. The engine 12 has forward and rearward cylinder housings or blocks 12*a* and 12*b* (with suitable air cooling fins), and a power take-off shaft, which may be extended at 13. See FIG. 7. Also, the engine has an air/fuel intake manifold 14 above the level of the power take-off shaft.

In accordance with the invention, a blower 15 (for example a Roots blower having two counter-rotating lobes) has a longitudinally elongated housing 15*a* containing the blower parts. A blower input shaft 16 in FIG. 1*a* is connected to a drive coupled between that shaft and the power take-off shaft 13. See for example the right angle drive unit 17 in FIG. 1*a*, the driven rotor (such as a pulley) 18 connected to the unit 17, the drive rotor 19 (such as a pulley) on shaft 13, and the endless, flexible element 20 entrained on rotors 18 and 19. Element 20 may comprise a belt, tensioned by an idler pulley 21 rotating on a shaft 21*a*, adjustably mounted, for example, to the motorcycle engine or frame. Thus, the engine drives the supercharger in the manner shown and described. Housing 15*a* is closely adjacent the side of the engine.

Figure 4:
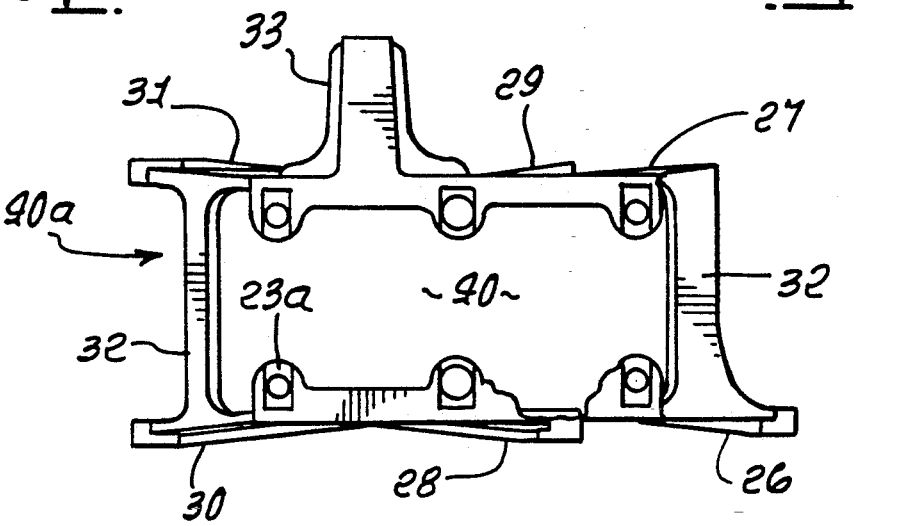
FIG. 4 is a top plan view of the FIG. 3 platform.
Figure 5:
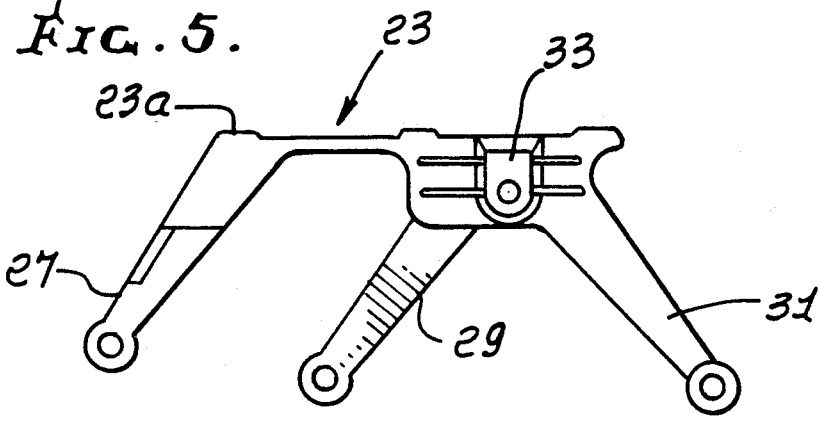
FIG. 5 is a rear side view of the platform taken on lines 5—5 of FIG. 4.
Figure 6:
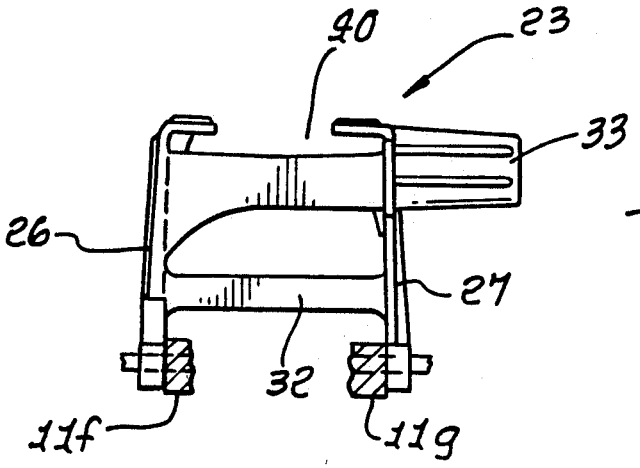
FIG. 6 is a rear end view of the platform taken on lines 6—6 of FIG. 3.
Figure 7:
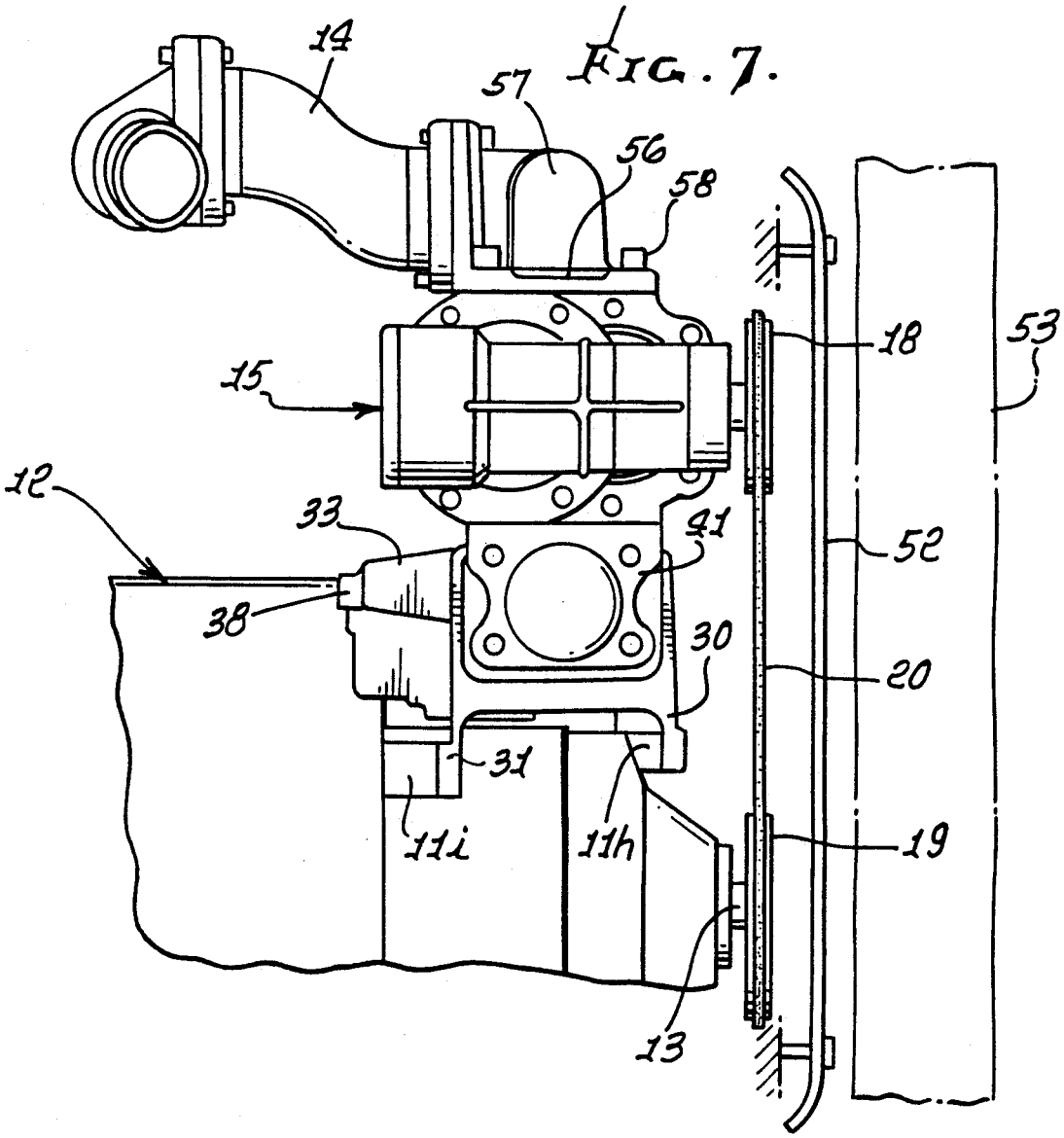
FIGS. 7 and 8 are front and rear views of the mounted supercharger and its platform.
Figure 8:
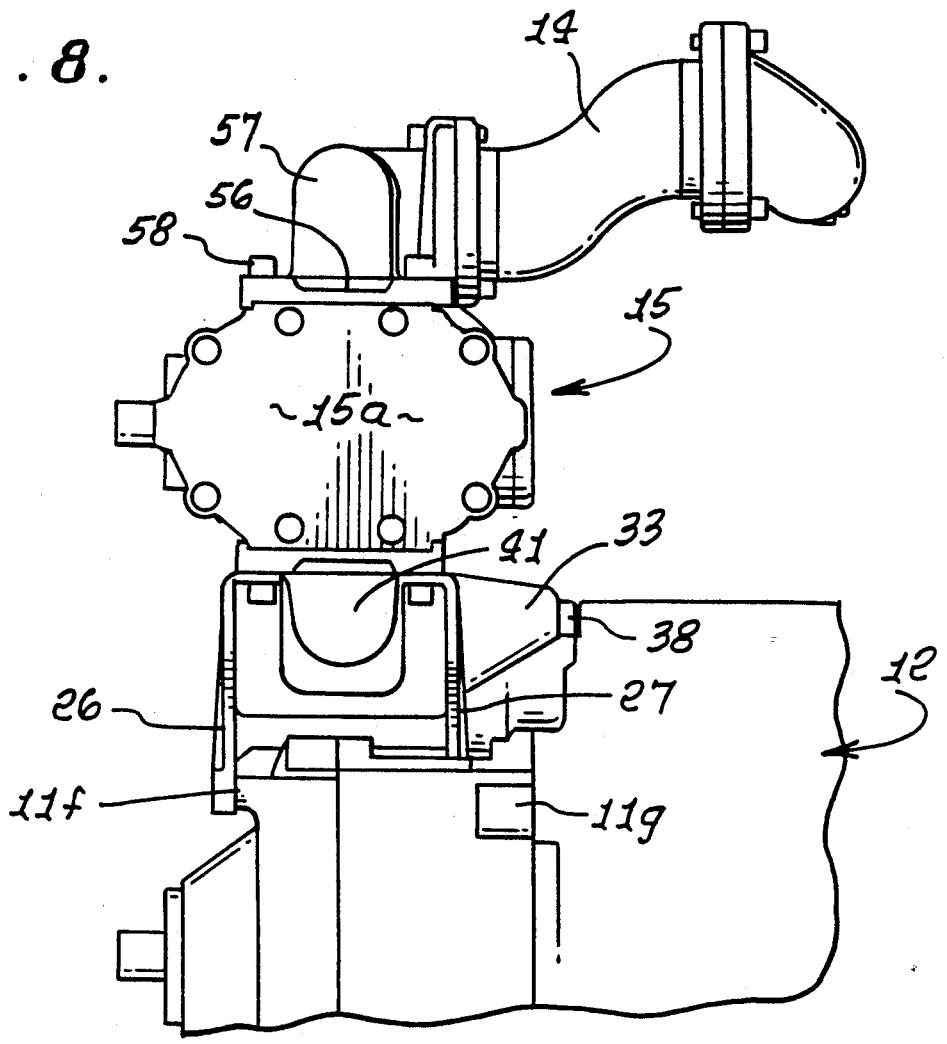
Figure 12:
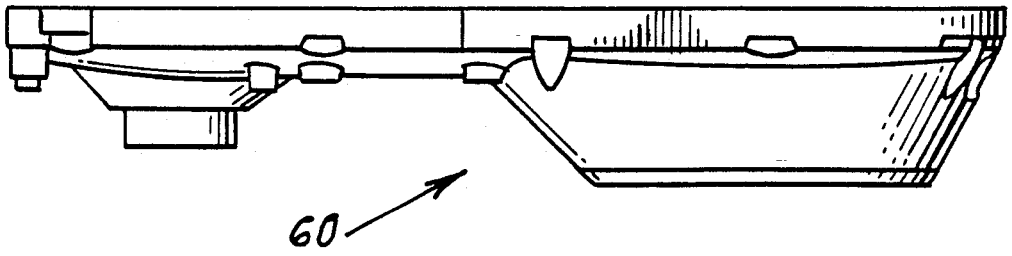
FIG. 12 is a top plan view of the FIG. 9 plate.
Figure 9:
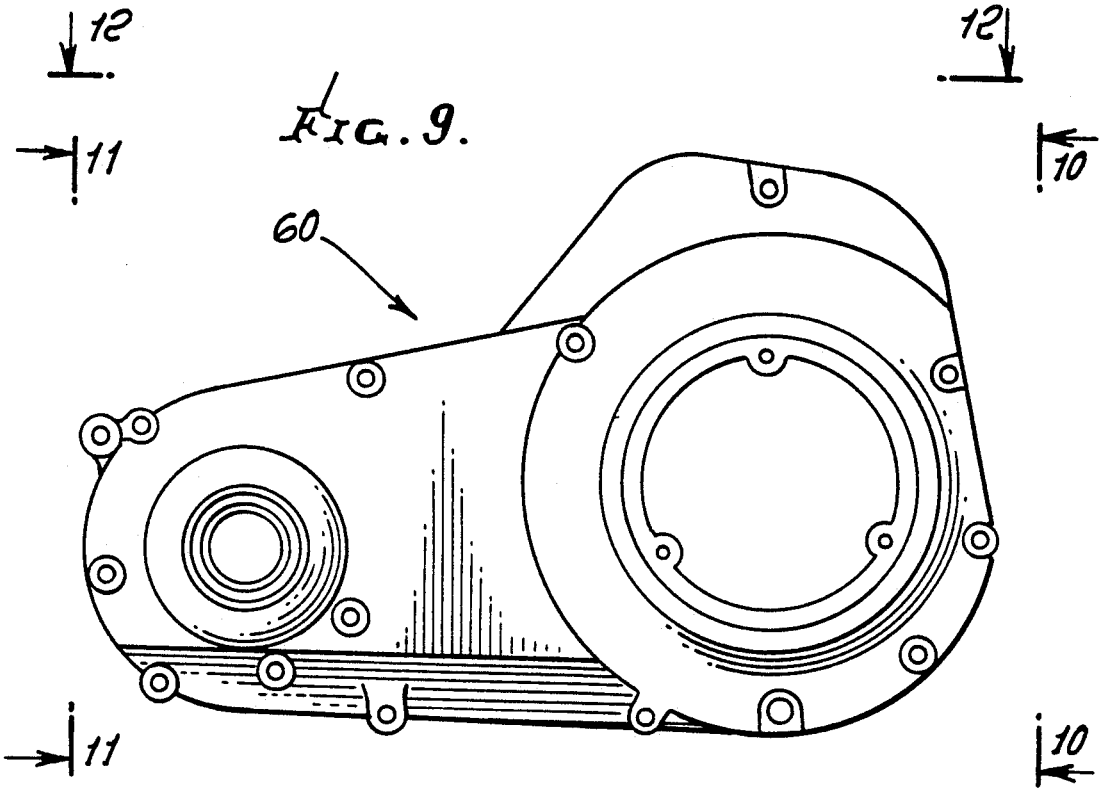
FIG. 9 is a side elevation showing a cover plate.
Figure 11:
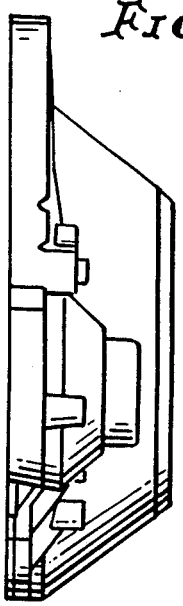
FIG. 11 is a left end view of the FIG. 9 plate.
Figure 10:
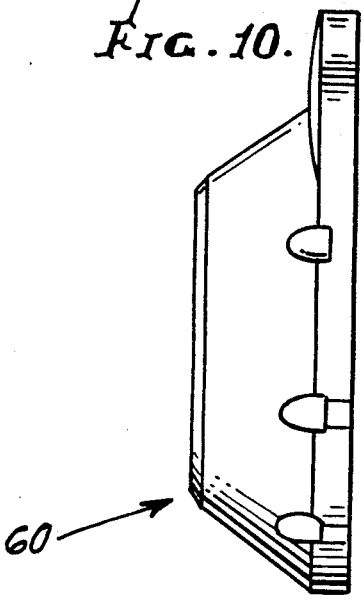
FIG. 10 is a right end view of the FIG. 9 plate.

The supercharger (blower) housing 15*a* is carried by or mounted on a support sidewardly of the engine. See for example the metal platform 23 extending horizontally with the housing 15*a* bolted to the platform top 23*a* at the locations 24. The support has mounting arm means operatively connected to the motorcycle engine or frame, whereby the housing 15*a* may be rigidly carried to extend longitudinally and closely sidewardly to the engine cylinders. The arm means referred to may include left and right pairs of arms 26 and 27, 28 and 29, and 30 and 31, the upper ends of which are integral with the platform. The arms of each pair are rigidly interconnected, as by cross bars 32 seen in FIGS. 4 and 6, whereby a very strong, reinforced, box-like support is provided for the supercharger. Arm lower ends are bolted to frame or engine structure, as for example is seen at 11*f* and 11*g* in FIGS. 6 and 8, and at 11*h* and 11*i* in FIG. 7. Note also the side arm 33 integral with the platform proximate the apexes formed by arms 29 and 31, and projecting laterally for connection to the engine at 38, as seen in FIGS. 7 and 8. This rigidizes the support, laterally, while allowing for very compact construction.

The platform is typically centrally vertically open, at 40, and forwardly open at 40*a*, to provide access of a blower air/fuel inlet manifold 41, for connection to the underside of the blower housing, at the housing air inlet, in a very compact relation. That manifold extends forwardly beneath the level of the rotor 18, and is operatively connected to means supplying fuel and air to the manifold. See in FIG. 2 the air intake filter 46 and carburetor 47 (or a fuel injector), interconnected at 48, and connected at 49 to the forward end of the manifold. Accordingly, the platform carries all of the supercharger structure, including the bolt-on housing 15*a*, inlet manfolding 41, and the drive parts 73 and 18 in a highly compact manner, easily assembled by the user. If desired, the tensioning pulley 21 for belt 20 entrained around pulleys 18 and 19 can be carried by the arm means integral with the platform, as indicated at 50 in FIG. 2. A side cover plate can be provided, as seen at 52 in FIG. 7, to cover the drive elements, the leg of the rider also indicated at 53 in FIG. 7.

Duct means is also provided to extend between the supercharger housing upper outlet 56 and the engine air/fuel intake manifold 14. See the ducting at 57 in FIG. 7, and bolted at 58 to the top of the manifold housing. Manifold 14 extends from ducting 57, laterally, to a V-shaped region between the forward and rearward engine cylinder blocks (finned).

FIGS. 2 and 9–12 show a second upright and protection cover plate 60 bolted to the frame, and sidewardly covering the lower (drive) pulley or rotor 19, and cycle structure rearward thereof. See bolts 60*a*, and engine crankcase 10*b*.

FIG. 13 schematically shows the supercharger housing 15 located generally forwardly of the lower extent of the engine 12, the blower input shaft extending generally laterally relative to the engine. Pulley 18 is thus directly mounted on the blower input shaft 16 (no 90° drive 73 is needed). Platform structure 23 is then bolted to frame bars forwardly of the engine.

Further, the invention also contemplates the provision of a second blower housing 15', blower parts rotatable within the housing and blower input shaft means 60 operatively connected with the blower parts, a second support 23' carrying the second housing 15' sidewardly of opposite side of the engine, the support having arm means bolt-connected to the motorcycle frame, whereby the housing is elongated lengthwise of the frame, the drive 18', 19' and 20' also connected with the second blower input shaft means, the second blower housing having an air inlet, and a pressurized air outlet at the upper side of the housing, and second duct means 57' extending between the second housing air outlet and the engine intake manifold.

See in this regard FIG. 13*a* with the second blower and its structure having the same numbers as the first blower, but with primes, the two blowers located at opposite lateral sides of the engine. Opposite engine power take-off shafts drive the two superchargers, or one take-off shaft may drive one supercharger, and a transfer shaft may drive the second supercharger, as described below.

Referring to the kit of FIGS. 14–19, the supercharger blower housing 15*a* is the same as in FIGS. 1, 1*a* and 2. The lobes are carried on two rotating shafts 16 and 16*a*, that are bearing mounted at bearings 62 and 63 in housing end cover plate 64, and at bearings 65 and 66 in housing end cover plate 67, each plate thus serving as a bearing plate, the plates being alike for interchangeability. Bolts 68 attach the housing to plate 64; and bolts 69 attach the housing to the plate 67. Similarly, bolts 68*a* attach the intake ducting or manifold 41 to housing 15*a*; and bolts 69*a* attach the discharge ducting or manifold 57 to the housing 15*a* at its top side. The bolts and holes 68*b* and 69*b* are symmetrically located to enable endwise reversal of each manifold 41 and 57, and also placement of manifold 57 under the housing 15*a*, and placement of manifold 41 above the housing, facilitating different mounting positions of the supercharger on the motorcycle. The manifolds can each be endwise reversed, if desired, accommodating the kit to various mounted positions on the motorcycle. See FIGS. 20–41. Manifold inlets appear at 57*b*.

An adapter plate 70 is also provided to bolt to the opposite side of plate 67, as via bolts 71 projecting through openings in flange 72. The adapter plate is constructed at its opposite end face 70*a* to accommodate straight through drive (180° drive); fixed 90° drive (as per FIG. 1*a*); or 90° drive from different directions. Thus, a 90° drive housing 73 has an end plate 73*a* that can bolt onto plate flange 70*a* via fasteners 74 in one fixed position, wherein drive shaft 75 projects in the direction of arrow 76, or can project in another and opposite direction (see arrow 77) for versatility of engine and belt drive to the supercharger in different mounting positions relative to the engine. The plate 73*a* can also bolt onto plate 70 at quarter (90°) intervals about the axis of the supercharger-driven shaft. See bolt holes 74*a*. See belt pulley 18 on shaft 75. Alternatively, the 180° drive unit 81, as seen in FIG. 19*a*, can be bolted to plate 70, as via fasteners 82 shown in FIG. 19*a*. See straight through (180°) shaft 84, in housing 81*a*, and engine and belt driven pulley 85 on that shaft. An idler pulley 86 may also be carried by the unit 81, housing 81*a*, arm 81*b*, and shaft 81*c*.

FIG. 20 shows installation of the kit, with supercharger blower 15 mounted at the rear of the engine 12. See also carburetor 47, inlet manifold 41, outlet manifold 57, engine intake manifold 14, intake duct or part 14*a* to the engine, drive belt 20, drive pulley 19, driven pulley 18, idler pulley 21, all positioned as shown. The 180° input drive of FIG. 19*a* is used.

FIG. 21 shows the supercharger blower unit 15 mounted at the lower front of the engine. Other elements, as referred to above in FIG. 20, are also shown. The 180° input drive of FIG. 19*a* is used.

In FIGS. 22 and 22*a*, the supercharger 15 is mounted at the right side of the engine, as via platform 23, referred to above. See platform attachments to the frame at 26*a*, 28*a* and 30*a*. The 90° drive housing 73 of FIG. 14 is employed. Carburetor 47 projects forwardly and below supercharger level. Note in FIG. 22*a* that an intermediate power transfer shaft 90 is employed forwardly of the engine front cylinder, with intermediate pulleys 91 and 92 on that shaft, to transfer power from pulley 19 to pulley 18. See also belts 94 and 95. Shaft 90 is suitably supported, as at 96.

In FIG. 23, the construction is the same as in FIG. 2, except that the carburetor 47 and manifold 41 are now at the upper side of the blower housing 15*a*, and manifold 57 is below the housing, the belts and threaded bolt holes facilitating such reversal. Modified intake manifold duct 14*c* facilitates this. The drive to the blower is the 90° unit 73 seen in FIG. 14. See also FIG. 23*a*.

In FIG. 24, the construction is the same as in FIG. 23, except that the supercharger is mounted at the right side of the engine; and a transfer shaft is again used at 90, as in FIG. 22*a*. See also FIG. 24*a*.

In FIG. 25, the construction is like FIG. 23, except that the carburetor 47 and manifold 41 are endwise reversed, to project rearwardly.

In FIG. 26 the construction is like that of FIG. 25, except that the supercharger is now mounted at the right side of the engine, as in FIG. 24. The carburetor 47 projects rearwardly.

In FIG. 27, the construction is like that of FIG. 2, except that the supercharger housing 15*a* is itself endwise reversed, so that the 90° drive unit 73 of FIG. 13*a* is at the rearward end of the supercharger. Idler 21 may now be carried by the support arm 28. See also FIG. 27*a*.

In FIG. 28, the construction is like that of FIG. 27, except that the supercharger is now at the right side of the engine. See also FIG. 28*a* cross-over shaft 90.

In FIG. 29, the construction is like that of FIG. 27, except that the carburetor 47 and inlet manifold 41 are endwise reversed, to project rearwardly.

In FIG. 30, the construction is like that of FIG. 29, except that the supercharger is mounted at the right side of the engine (rear 90° drive, bottom rear carburetor, top intake manifold, and mounted right side of engine). See also FIG. 30*a*.

FIG. 31 is like FIG. 27, except that the carburetor 47 and manifold 41 are above supercharger blower level and project forwardly.

FIG. 32 is like FIG. 28, except that the carburetor 47 and manifold 41 now project forwardly above the supercharger housing level.

FIG. 33 is like FIG. 32, except that the supercharger is mounted at the left side of the engine, and the carburetor 47 projects rearwardly, above the level of blower housing 15*a*. See also FIG. 33*a*.

FIG. 34 is like FIG. 33, except that the supercharger is mounted at the right side of the engine. See also FIG. 34*a*.

In FIG. 35, the two superchargers 21′ and 8′ are mounted vertically, i.e., their lobe shafts are vertical to be driven by pulleys 18′ and 7′, belts 6′, 12′, and 17′, pulley 14′, and pulley 4′, as shown. Engine crankcase 1′ has a shaft 3′ driving pulley 4′. The pressurized air/fuel mixtures from the supercharger pass via ducts 23′ to the engine inlet manifold 24′. The engine cylinders are indicated at 13′. Drives to the superchargers are 90°, as per 73 in FIG. 14. Fuel tank 26′ is associated with motorcycle frame 25′. See also idlers 5′, 15′ and 16′.

In FIG. 36, the construction is like that of FIG. 35, except that the carburetors 9′ and 20′ now project forwardly, not rearwardly, as in FIG. 35.

In FIG. 37, the blower housings are rotated 90° about vertical axes, so that the carburetors 9 and 20 now project laterally rightwardly and leftwardly.

In FIG. 38, the carburetors 9′ and 20′ now face rearwardly, and the blower housings 8′ and 21′ extend horizontally forwardly as do the lobe shafts. The drives 18′ and 7′ are at the forward ends of 8′ and 21′.

In FIG. 39, the construction is the same as in FIG. 38, except that the supercharger blower and carburetors, and drives, are endwise reversed. See motorcycle front wheel 200, and rear wheel 201, and frame 202.

In FIG. 40, the drive to the two superchargers 8′ and 21′ is via a transverse lateral shaft 28′ at the rear of the rear cylinder. See also pulleys 29*a*′ and 29*b*′, and belts 17′ and 12′ connected to 90° drives 27*a*′ and 27*b*′ to the supercharger.

In FIG. 41, the transverse power shaft 28′ is located between the two cylinder; but otherwise, the structure is the same as in FIG. 40.

In FIG. 42, the transverse power shaft 28′ is forward of the front cylinder of the engine.

I claim:

1. In motorcycle supercharger kit apparatus, the motorcycle having a forwardly extending frame, an engine carried by the frame, the engine having a power take-off shaft that extends sidewardly relative to the frame, the engine having an intake manifold above the level of said take-off shaft, the combination comprising a) a blower including an elongated longitudinally extending housing, blower parts rotatable within the housing and blower input shaft means operatively connected with said blower parts, and a support carrying said housing and including arm means connected to the frame, b) a drive connected between said power take-off shaft and said blower input shaft means, c) said blower housing having an air inlet, and a pressurized air outlet, said outlet being at one side of the housing, d) duct means extending between said outlet and said engine intake manifold, e) and wherein said support includes a platform which extends lengthwise of said blower housing, said arm means includes arms which are spaced lengthwise of said platform and project at a side of the platform and away from the blower housing, for bolt connection to the motorcycle engine or frame.

2. The apparatus of claim 1 wherein said drive includes a first rotor connected to the power take-off shaft, a second rotor at the level of the blower housing and operatively connected to the blower input shaft means, and an endless, flexible element entrained on said first and second rotors to transmit rotary drive therebetween.

3. The apparatus of claim 2 wherein said rotors comprise pulleys and said endless element comprises a belt, and also having a idler pulley carried by the platform and sidewardly engaging said belt to tension same.

4. The apparatus of claim 3 wherein said first rotor is generally below the blower housing and the second rotor is generally forward of the blower housing, the drive including a connection between the second rotor and the blower input shaft means.

5. The apparatus of claim 4 wherein said connection between the second rotor and the blower input shaft means comprises a 90° sub-drive, the blower input shaft means defining a longitudinally forwardly extending axis, and the first and second rotors defining laterally extending axes.

6. The apparatus of claim 7 wherein said blower housing air inlet is located at the underside of the blower housing, there being an air/fuel inlet manifold extending from said blower housing air inlet forwardly beneath the level of said second rotor, and is operatively connected to means supplying fuel and air to said manifold.

7. The apparatus of claim 6 wherein the support defines an opening to pass said inlet manifold, at the underside of the housing.

8. The apparatus of claim 5 including a cover plate extending in a generally vertical plane to cover said first and second rotors and said endless element, said plate being carried by the motorcycle engine or frame, and generally sidewardly close to the engine cylinders.

9. The apparatus of claim 1 wherein said duct means is attached to the upper side of the blower housing and extends laterally toward said engine intake manifold located between forward and rearward engine cylinders, said blower housing also located in closely laterally spaced relation to said forward and rearward cylinders.

10. The apparatus of claim 1 including a second blower housing, blower parts rotatable within the housing and blower input shaft means operatively connected with said blower parts, a second support carrying said second housing sidewardly of said engine, said second support having arm means bolt-connected to the motorcycle engine or frame, whereby the second blower housing is elongated lengthwise of the frame, said drive also connected with said second blower input shaft means, said second blower housing having an air inlet, and a pressurized air outlet at the upper side of the housing, and second duct means extending between said second housing air outlet and said engine intake manifold.

11. The apparatus of claim 10 wherein said first-mentioned blower housing is located at one lateral side of said engine, and said second blower housing is located at the opposite lateral side of said engine.

12. The apparatus of claim 1 wherein said blower housing is located forwardly of said engine, and said blower input shaft means extends generally laterally relative to the engine.

13. The apparatus of claim 1 comprising a plate means at one end of said housing, said connector means includes a drive housing having different connected positions relative to said plate means.

14. The apparatus of claim 13 wherein said drive housing and said plate means have fastener openings that register in each of said different connected positions of said drive housing relative to said plate means.

15. The apparatus of claim 14 wherein the blower is located on one of the following positions relative to said engine i) at the left side of the engine
ii) at the right side of the engine
iii) at the front of the engine
iv) at the rear of the engine.

16. The apparatus of claim 15 including a carburetor operatively connected with said blower housing and in communication with said housing air inlet to pass an air/fuel mixture thereto.

17. The apparatus of claim 1 including a carburetor operatively connected with said blower housing and in communication with said housing air inlet to pass an air/fuel mixture thereto.

18. The apparatus of claim 1 including a carburetor having a discharge, and a manifold mounting the carburetor to the blower housing air inlet, and means connecting said manifold to the blower housing to allow one of the following:

i) carburetor located forwardly of the blower housing
ii) carburetor located rearwardly of the blower housing.

19. In motorcycle supercharger kit apparatus, the motorcycle having a forwardly extending frame, an engine carried by the frame, the engine having a power take-off shaft that extends sidewardly relative to the frame, the engine having an intake manifold above the level of said take-off shaft, the combination comprising a) a blower including an elongated longitudinally extending housing, blower parts rotatable within the housing and blower input shaft means operatively connected with said blower parts, and a support carrying said housing and including arm means connected to the frame,
b) a drive connected between said power take-off shaft and said blower input shaft means,
c) said blower housing having an air inlet, and a pressurized air outlet, said outlet being at one side of the housing,
d) duct means extending between said outlet and said engine intake manifold,
e) and wherein said support includes a platform which extends lengthwise of said blower housing, said arm means includes arms which are spaced lengthwise of said platform and project at the side of the platform opposite the blower housing, for bolt connection to the motorcycle engine or frame.

20. The apparatus of claim 19 wherein said arm means includes at least three longitudinally spaced arms which project downwardly below the level of the platform and below the blower housing, the arm means including a laterally extending arm integral with the platform and projecting toward the motorcycle engine for connection to same.

21. The apparatus of claim 19 including a carburetor operatively connected with said platform and in communication with said blower air inlet to pass an air/fuel mixture thereto.

22. In motorcycle supercharger kit apparatus, the motorcycle having a forwardly extending frame, an engine carried by the frame, the engine having a power take-off shaft that extends sidewardly relative to the frame, the engine having an intake manifold, the combination comprising a) a blower including an elongated longitudinally extending housing, blower parts rotatable within the housing and blower input shaft means operatively connected with said blower parts,
b) a drive connected between said power take-off shaft and said blower input shaft means,
c) said blower housing having an air inlet, and a pressurized air outlet, d) duct means extending between said outlet and said engine intake manifold, e) and support means supporting said blower and drive, to position the blower in one of the following positions:

i) at the side of the engine, ii) at the front of the engine, iii) at the rear of the engine, iv) vertically of the support means, the support means including a platform which extends lengthwise of the blower housing, said arm means spaced lengthwise of the platform and projecting away from the platform and away from the blower housing for fastener connection to the motorcycle engine or frame.

* * * * *